US011501710B2

(12) United States Patent
Ohara

(10) Patent No.: US 11,501,710 B2
(45) Date of Patent: Nov. 15, 2022

(54) DISPLAY DEVICE AND METHOD OF DRIVING DISPLAY DEVICE

(71) Applicant: JOLED INC., Tokyo (JP)

(72) Inventor: Masanori Ohara, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/573,150

(22) Filed: Jan. 11, 2022

(65) Prior Publication Data

US 2022/0230584 A1 Jul. 21, 2022

(30) Foreign Application Priority Data

Jan. 15, 2021 (JP) ..... JP2021-004761

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0842* (2013.01); *G09G 2310/0286* (2013.01); *G09G 2310/08* (2013.01)

(58) Field of Classification Search
CPC .. G09G 3/3233; G09G 3/3225; G09G 3/3266; G09G 3/3258; G09G 3/3275; G09G 2300/0819; G09G 2300/0861; G09G 2300/0842; G09G 2300/0426; G09G 2300/0814; G09G 2300/0465; G09G 2310/0262; G09G 2310/0251; G09G 2310/0286; G09G 2310/0264; G09G 2320/045
See application file for complete search history.

(56) References Cited

U.S. PATENT DOCUMENTS

2005/0243039 A1* 11/2005 Kwak ..... G09G 3/3233 345/76
2006/0145964 A1* 7/2006 Park ..... G09G 3/3266 345/76
2007/0124633 A1* 5/2007 Kim ..... G09G 3/3266 714/726

(Continued)

FOREIGN PATENT DOCUMENTS

JP 2020-118952 8/2020

*Primary Examiner* — Dong Hui Liang
(74) *Attorney, Agent, or Firm* — Greenblum & Bernstein, P.L.C.

(57) ABSTRACT

A display device includes: a display portion including a plurality of pixel circuits arranged in a matrix; and a gate driver that outputs one driving pulse for each horizontal cycle. The plurality of pixel circuits each include subpixel circuits each including a light emitting element, a driving transistor that supplies a current to the light emitting element, a write transistor, a reference transistor, and an initialization transistor. The one driving pulse is input per vertical cycle from the gate driver to the initialization transistor included in each of a plurality of rows in the plurality of pixel circuits, and the one driving pulse input to the initialization transistors included in mutually different rows among the plurality of rows is input to each of the write transistor and the reference transistor, the mutually different rows being other than a row in which the write transistor and the reference transistor are included.

8 Claims, 18 Drawing Sheets

(56) References Cited

U.S. PATENT DOCUMENTS

| | | | | |
|---|---|---|---|---|
| 2008/0238835 | A1* | 10/2008 | Asano | G09G 3/3233 345/76 |
| 2018/0190197 | A1* | 7/2018 | Chang | H01L 27/3262 |
| 2020/0234640 | A1 | 7/2020 | Ohara | |

* cited by examiner

DISPLAY DEVICE AND METHOD OF DRIVING DISPLAY DEVICE

CROSS REFERENCE TO RELATED APPLICATION

The present application is based on and claims priority of Japanese Patent Application No. 2021-004761 filed on Jan. 15, 2021. The entire disclosure of the above-identified application, including the specification, drawings and claims is incorporated herein by reference in its entirety.

FIELD

The present disclosure relates to a display device and a method of driving the display device.

BACKGROUND

Conventionally, active-matrix display devices (hereinafter referred to as display devices) using light emitting elements such as organic electro-luminescence (EL) elements have been put to practical use (see, for example, Patent Literature (PTL) 1). The display device includes a plurality of pixel circuits which are arranged in a matrix. Each of the plurality of pixel circuits includes three subpixel circuits on which organic EL elements respectively having luminescent colors of red (R), green (G), and blue (B) are mounted. The subpixel circuits each include an initialization transistor, a reference transistor, and a write transistor. Switching of each of the initialization transistor, the reference transistor, and the write transistor is performed according to a control signal from a gate driver. The display device displays a color image by controlling the luminance for each of the subpixel circuits according to signals from the gate driver and a source driver.

CITATION LIST

Patent Literature

PTL 1: Japanese Unexamined Patent Application Publication No. 2020-118952

SUMMARY

Technical Problem

In the conventional display devices, gate drivers of at least three systems are required in order to supply a control signal to each of the initialization transistor, the reference transistor, and the write transistor. For that reason, a region for placing the gate drivers of at least three systems is required at the periphery of a display portion of the display device. Accordingly, with conventional display devices, the width of a display frame located at the periphery of the display portion cannot be reduced to be less than the width of the region for placing the gate drivers of three systems.

The present disclosure is to solve the above-described problem, and provides a display device, etc. of which the width of the display frame can be reduced.

Solution to Problem

In order to achieve the above-described object, a display device according to an aspect of the present disclosure is a display device including a display portion including a plurality of pixel circuits arranged in a matrix; and a gate driver that outputs one driving pulse for each horizontal cycle. In the display device, the plurality of pixel circuits each include one or more subpixel circuits, and the one or more subpixel circuits each include a light emitting element, a driving transistor that supplies a current to the light emitting element, a write transistor, a reference transistor, and an initialization transistor, the write transistor switches a conduction state between a gate electrode of the driving transistor and a data signal line to which a data signal corresponding to a luminance of the light emitting element is input, the reference transistor switches a conduction state between the gate electrode of the driving transistor and a reference potential line to which a reference potential is applied, the initialization transistor switches a conduction state between the light emitting element and an initialization potential line to which an initialization potential is applied, the one driving pulse is input per vertical cycle from the gate driver to the initialization transistor included in each of a plurality of rows included in the plurality of pixel circuits, and the one driving pulse input to initialization transistors included in mutually different rows among the plurality of rows is input to each of the write transistor and the reference transistor, the initialization transistors being the initialization transistor, the mutually different rows being other than a row in which the write transistor and the reference transistor are included.

In addition, in the method of driving the display device according to an aspect of the present disclosure, the display device includes: a display portion including a plurality of pixel circuits arranged in a matrix; and a gate driver that outputs one driving pulse for each horizontal cycle. In the display device, the plurality of pixel circuits each includes one or more subpixel circuits, and the one or more subpixel circuits each includes a light emitting element, a driving transistor that supplies a current to the light emitting element, a write transistor, a reference transistor, and an initialization transistor. The write transistor switches a conduction state between a gate electrode of the driving transistor and a data signal line to which a data signal corresponding to a luminance of the light emitting element is input. The reference transistor switches a conduction state between the gate electrode of the driving transistor and a reference potential line to which a reference potential is applied. The initialization transistor switches a conduction state between the light emitting element and an initialization potential line to which an initialization potential is applied. The method of driving the display device includes: inputting the one driving pulse per vertical cycle from the gate driver to the initialization transistor included in each of a plurality of rows included in the plurality of pixel circuits; and inputting the one driving pulse input to initialization transistors included in mutually different rows among the plurality of rows, to each of the write transistor and the reference transistor, the initialization transistors being the initialization transistor, the mutually different rows being other than a row in which the write transistor and the reference transistor are included.

Advantageous Effects

According to the present disclosure, it is possible to provide a display device, etc. of which the width of a display frame can be reduced.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Hereinafter, embodiments of the present disclosure will be described with reference to the Drawings. It should be noted that each of the embodiments described below shows a specific example of the present disclosure. Therefore, numerical values, shapes, materials, structural components, the arrangement and connection of the structural components, steps, the processing order of the steps etc., indicated in the following exemplary embodiments are mere examples, and are not intended to limit the scope of the present disclosure. Furthermore, among the structural components in the following embodiments, components not recited in the independent claims which indicate the broadest concepts of the present disclosure are described as arbitrary structural components.

In addition, each of the diagrams is a pattern diagram and thus is not necessarily strictly illustrated. Therefore, the scale sizes and the like are not necessarily exactly represented in each of the diagrams. In each of the diagrams, substantially the same structural components are assigned with the same reference signs, and redundant descriptions will be omitted or simplified.

Embodiment 1

The following describes a display device and a method of driving the display device according to Embodiment 1.

1-1. Overall Configuration of Display Device

Figure 1:
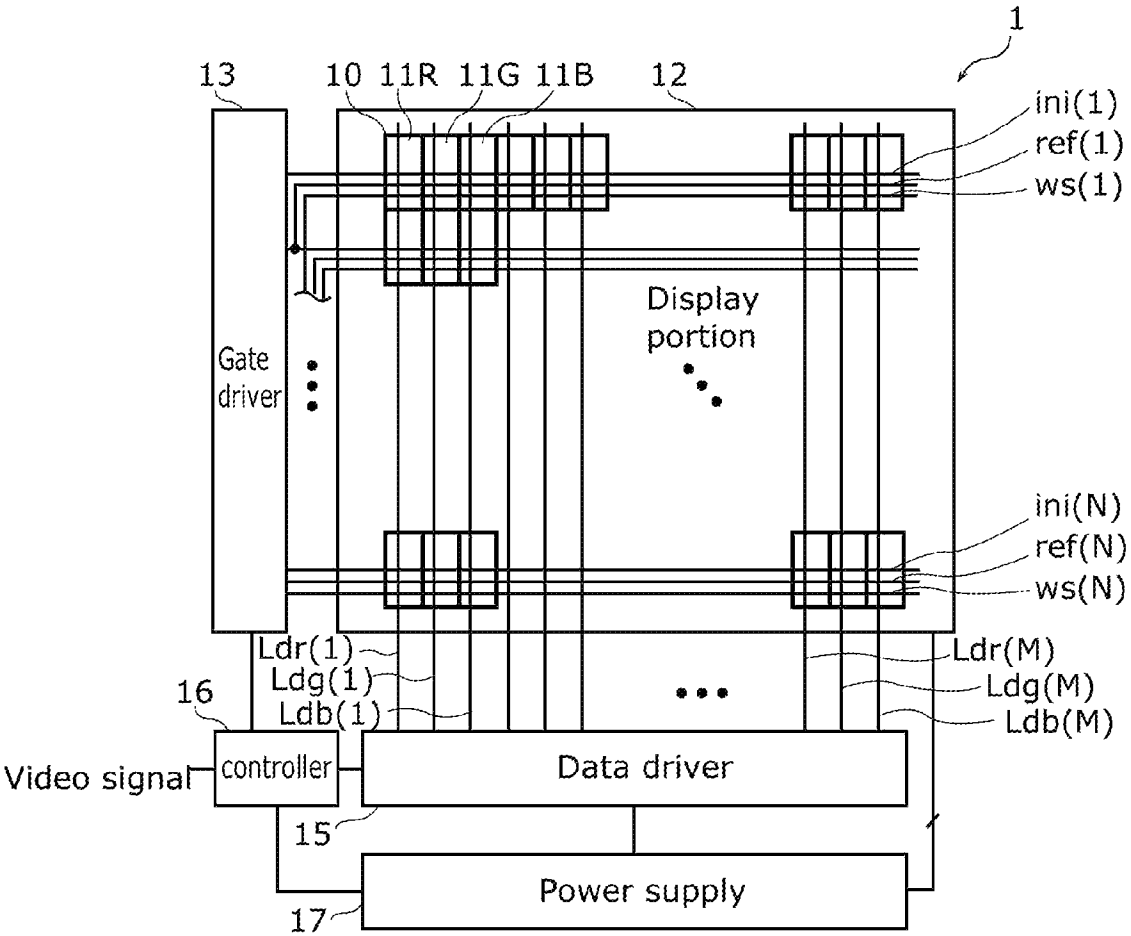
FIG. 1 is a block diagram illustrating an overall configuration of a display device according to Embodiment 1.

First, the overall configuration of the display device according to the present embodiment will be described with reference to FIG. 1. FIG. 1 is a block diagram illustrating the overall configuration of display device 1 according to the present embodiment.

Display device 1 according to the present embodiment includes display portion 12, gate driver 13, data driver 15, controller 16, and power supply 17 as illustrated in FIG. 1. According to the present embodiment, display device 1 is an active-matrix color display device.

Display portion 12 is an image display portion including a plurality of pixel circuits 10 arranged in a matrix. Each of the plurality of pixel circuits 10 includes at least one subpixel circuit. According to the present embodiment, each of the plurality of pixel circuits 10 includes subpixel circuits 11R, 11G, and 11B that correspond to the luminescent colors of R, G, and B, respectively.

Display portion 12 includes three control signal lines ini(i), ref(i), and ws(i) which are connected to the plurality of pixel circuits 10 arranged in each of the rows of the matrix (i denotes an integer greater than or equal to 1 and less than or equal to N. N denotes an integer greater than 1, which indicates the number of rows of the matrix). Control signal lines ini(i), ref(i), and ws(i) transmit, to pixel circuit 10, control signals respectively supplied from gate driver 13. It should be noted that the number of control signal lines and the control signals are mere examples, and thus are not limited to these examples.

Display portion 12 includes three data signal lines Ldr(j), Ldg(j), and Ldb(j) which are connected to the plurality of pixel circuits 10 arranged in each of the columns of the matrix (j denotes an integer greater than or equal to 1 and less than or equal to M. M denotes an integer greater than 1, which indicates the number of columns of the matrix). Data signal lines Ldr(j), Ldg(j), and Ldb(j) transmit, to pixel circuit 10, data signals respectively supplied from data driver 15. The data signals are related to the luminance of R, G, and B.

Controller 16 receives a video signal from outside, and supplies a signal for displaying, on display portion 12, an image of each frame corresponding to the video signal, to gate driver 13 and data driver 15.

Gate driver 13 is a circuit that outputs a control signal to display portion 12, based on the signal supplied from controller 16. Gate driver 13 sequentially outputs one driving pulse for each horizontal cycle. The configuration of gate driver 13 will be described later in detail.

Data driver 15 is a circuit that outputs a data signal to display portion 12, based on the signal supplied from controller 16.

Power supply 17 supplies a reference potential, a power supply potential, etc. to display portion 12, gate driver 13, data driver 15, and controller 16. For example, power supply 17 supplies, to display portion 12, a reference potential that is applied to reference potential line Lref, an initialization potential that is applied to initialization potential line Lini, a positive power supply potential that is applied to positive power supply line Lvcc, and a negative power supply potential that is applied to negative power supply line Lcat.

Figure 2:
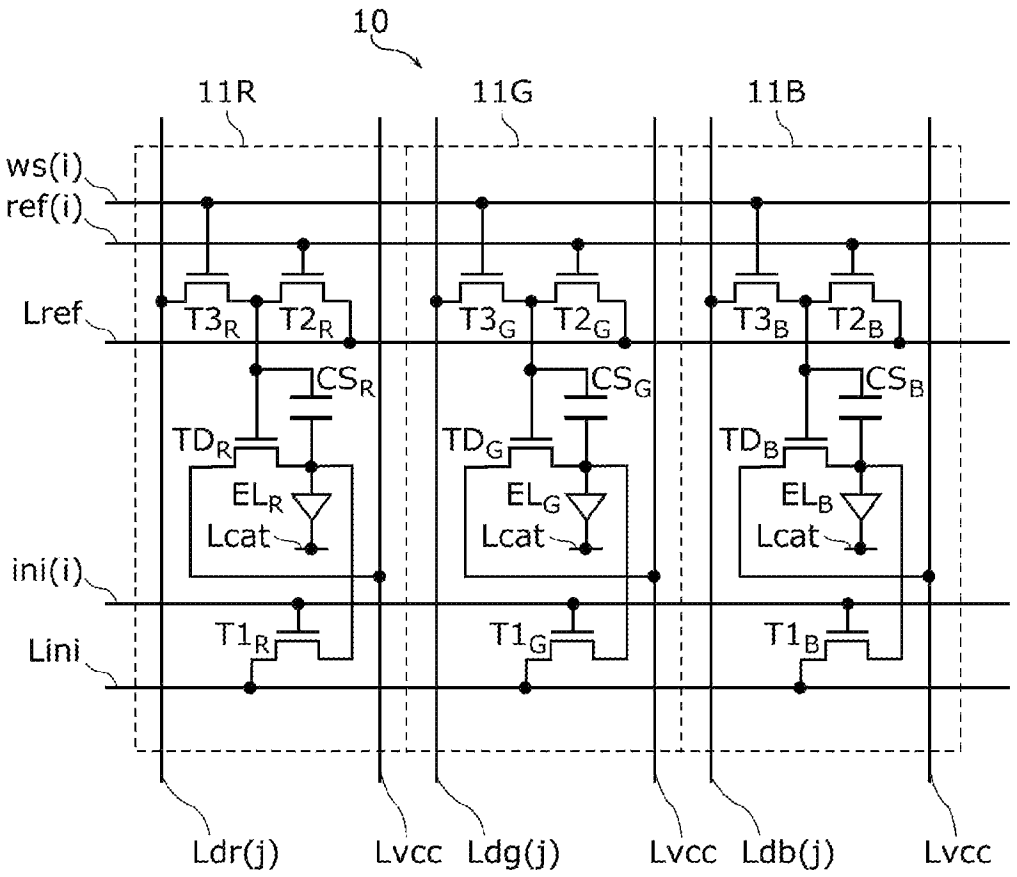
FIG. 2 is a circuit diagram illustrating an example of a configuration of a pixel circuit according to Embodiment 1.

Next, an example of the circuit configuration of pixel circuit 10 will be described with reference to FIG. 2. FIG. 2 is a circuit diagram illustrating an example of the configuration of pixel circuit 10 according to the present embodiment. FIG. 2 illustrates pixel circuit 10 located in the i-th row and j-th column among the plurality of pixel circuits 10. As illustrated in FIG. 2, subpixel circuits 11R, 11G, and 11B included in pixel circuit 10 have the same configuration as one another The following describes the configuration of pixel circuit 10, with a focus placed on subpixel circuit 11R.

Subpixel circuit 11R includes initialization transistor $T1_R$, reference transistor $T2_R$, write transistor $T3_R$, storage capacitor $CS_R$, driving transistor $TD_R$, and light emitting element $EL_R$. In addition, subpixel circuit 11R includes control signal lines ini(i), ref(i), and ws(i), initialization potential line Lini, reference potential line Lref, data signal line Ldr(j), positive power supply line Lvcc, and negative power supply line Lcat. It should be noted that control signal lines ini(i), ref(i), and ws(i) are also referred to as a first control signal line, a second control signal line, and a third control signal line, respectively.

Driving transistor $TD_R$ is a transistor that supplies a current to light emitting element $EL_R$. Driving transistor $TD_R$ supplies a current to light emitting element $EL_R$ according to a voltage stored in storage capacitor $CS_R$. According to this configuration, light emitting element $EL_R$ emits light at the luminance indicated by a data signal input to data signal line Ldr(j).

Write transistor $T3_R$ is a transistor that switches the conduction state between the gate electrode of driving transistor $TD_R$ and data signal line Ldr(j) to which a data signal corresponding to the luminance of light emitting element $EL_R$ is input. Write transistor $T3_R$ enters an ON state in accordance with a signal input to control signal line ws(i). As a result, the voltage of the data signal input to data signal line Ldr(j) is stored in storage capacitor $CS_R$.

Initialization transistor $T1_R$ is a transistor that switches the conduction state between light emitting element $EL_R$ and initialization potential line Lini to which the initialization potential is applied. Initialization transistor $T1_R$ enters an ON state in accordance with the control signal applied to the control signal line ini(i), and sets the source electrode of driving transistor $TD_R$ to the initialization potential applied to initialization potential line Lini.

Reference transistor $T2_R$ is a transistor that switches the conduction state between the gate electrode of driving transistor $TD_R$ and reference potential line Lref to which the reference potential is applied. Reference transistor $T2_R$ enters an ON state in accordance with the control signal input to control signal line ref(i), and sets the gate electrode of driving transistor $TD_R$ to the reference potential applied to reference potential line Lref.

For example, an N-channel metal-oxide semiconductor field-effect transistor (MOSFET) can be used as each of the above-described transistors. It should be noted that it is also possible to configure subpixel circuit 11R using a transistor other than the N-channel MOSFET. For example, it is also possible to configure subpixel circuit 11R using a P-channel MOSFET.

Light emitting element $EL_R$ is an element that emits light in subpixel circuit 11R. According to the present embodiment, an organic EL element is used as light emitting element $EL_R$. It should be noted that the element used as light emitting element $EL_R$ is not limited to the organic EL element. For example, a quantum-dot light emitting diode (QLED) element or the like may be used as light emitting element $EL_R$.

Subpixel circuits 11G and 11B have the configuration equivalent to the configuration of subpixel circuit 11R. As illustrated in FIG. 2, subpixel circuit 11G includes initialization transistor $T1_G$, reference transistor $T2_G$, write transistor $T3_G$, storage capacitor $CS_G$, driving transistor $TD_G$, and light emitting element $EL_G$. In addition, subpixel circuit 11G includes control signal lines ini(i), ref(i), and ws(i), initialization potential line Lini, reference potential line Lref, data signal line Ldg(j), positive power supply line Lvcc, and negative power supply line Lcat.

Subpixel circuit 11B includes initialization transistor $T1_B$, reference transistor $T2_B$, write transistor $T3_B$, storage capacitor $CS_B$, driving transistor $TD_B$, and light emitting element $EL_B$. In addition, subpixel circuit 11B includes control signal lines ini(i), ref(i), and ws(i), initialization potential line Lini, reference potential line Lref, data signal line Ldb(j), positive power supply line Lvcc, and negative power supply line Lcat.

Since pixel circuit 10 has the configuration as described above, data signals $Vdat_R$, $Vdat_G$, and $Vdat_B$ are stored at the same timing in accordance with the same control signal in subpixel circuits 11R, 11G, and 11B, and light emitting elements $EL_R$, $EL_G$, and $EL_B$ emit light at luminances corresponding to the stored data signals.

1-2. Gate Driver Configuration

Figure 3:
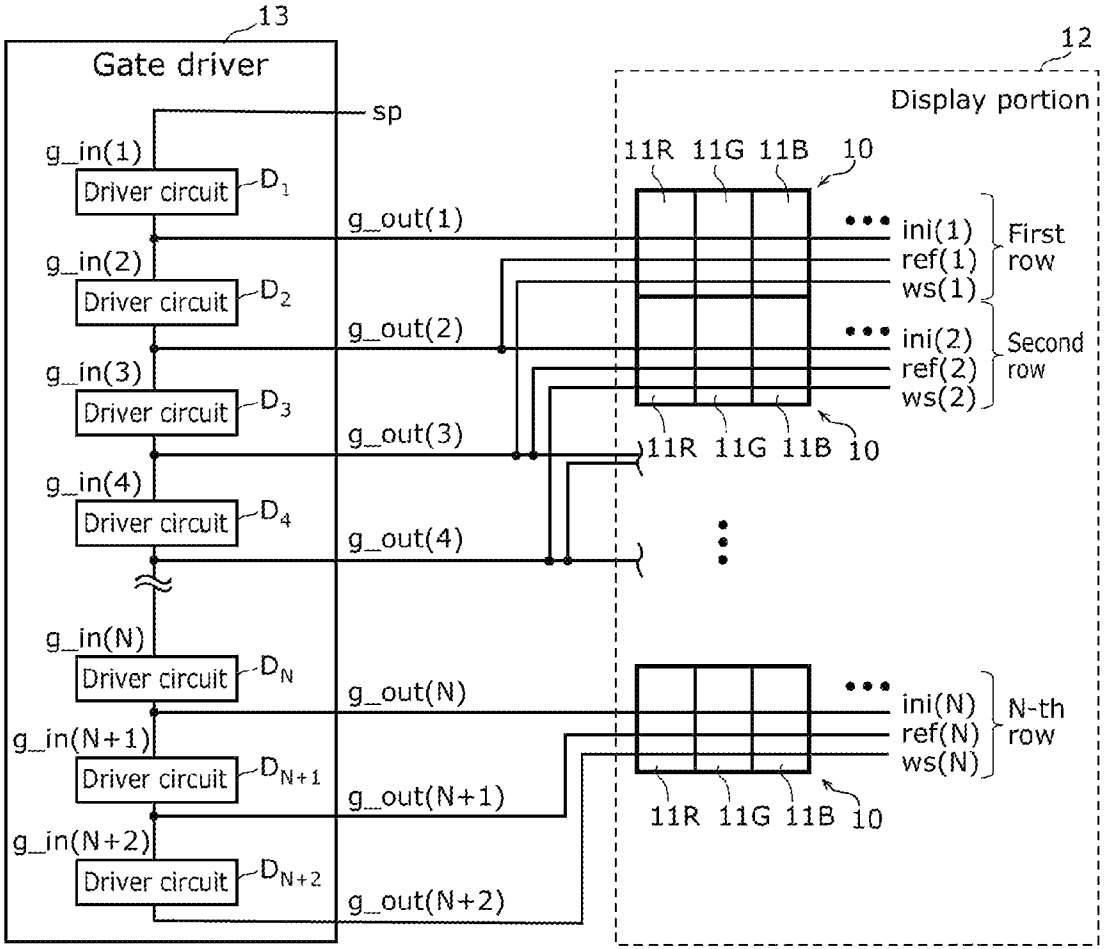
FIG. 3 is a block diagram illustrating a functional configuration of a gate driver according to Embodiment 1.
Figure 4:
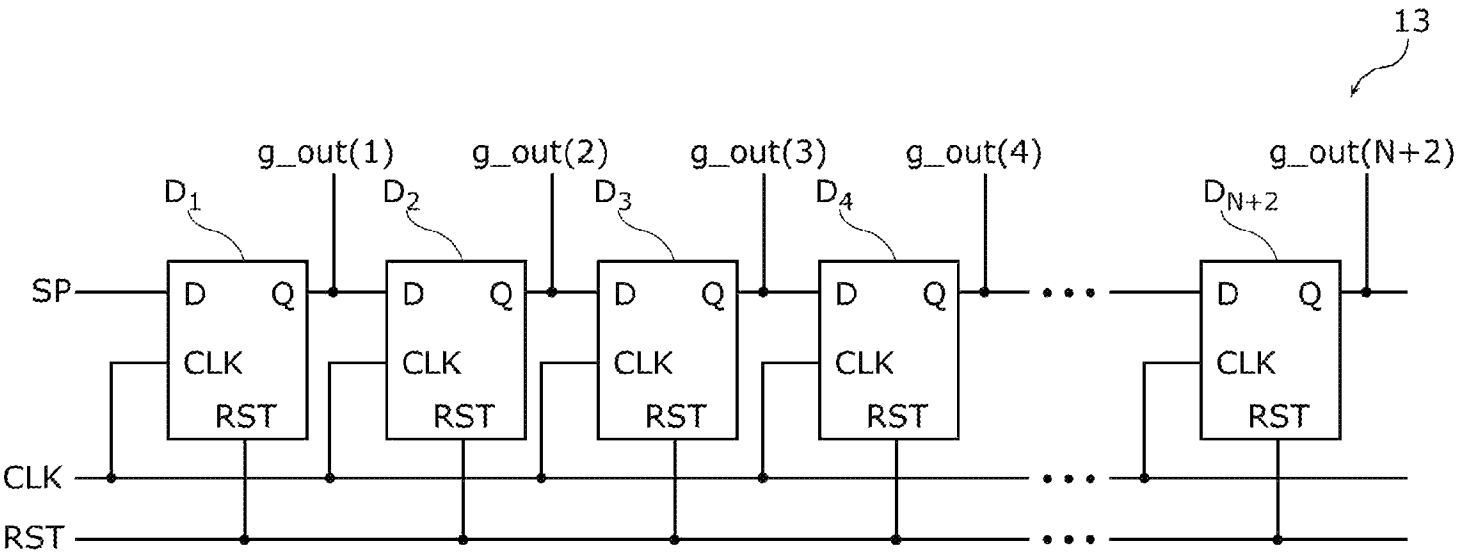
FIG. 4 is a diagram illustrating an example of a circuit configuration of the gate driver according to Embodiment 1.
Figure 5:
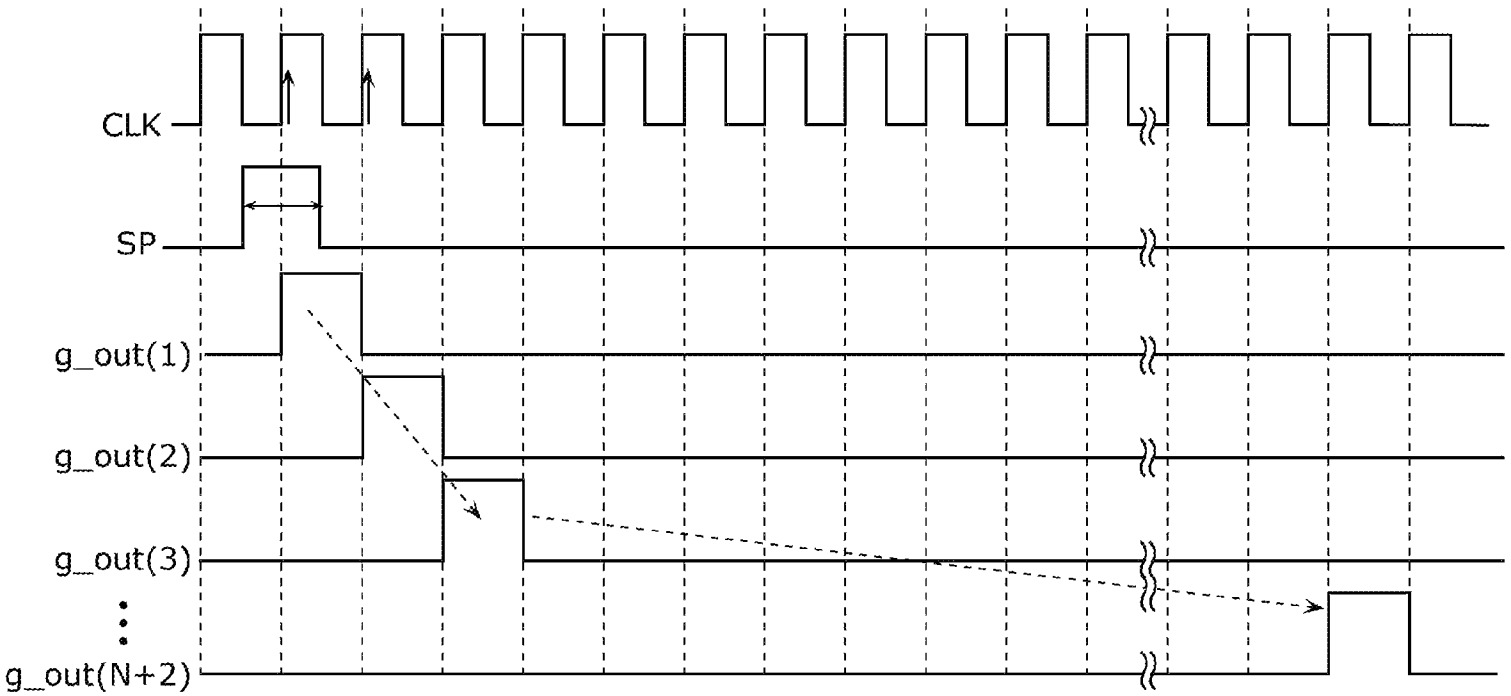
FIG. 5 is a diagram illustrating an example of the waveforms of output signals of the gate driver according to Embodiment 1.

Next, a configuration of gate driver 13 will be described with reference to FIG. 3 to FIG. 5. FIG. 3 is a block diagram illustrating a functional configuration of gate driver 13 according to the present embodiment. In FIG. 3, display portion 12 is also illustrated. FIG. 4 is a diagram illustrating an example of the circuit configuration of gate driver 13 according to the present embodiment. FIG. 5 is a diagram illustrating an example of the waveforms of output signals of gate driver 13 according to the present embodiment.

As illustrated in FIG. 3, gate driver 13 includes a plurality of driver circuits $D_1$ to $D_{N+2}$. According to the present embodiment, gate driver 13 is a shift register of one system which includes N+2 driver circuits $D_1$ to $D_{N+2}$ connected in cascade in a row. As illustrated in FIG. 4, for example, a flip-flop circuit can be used as each of driver circuits $D_1$ to $D_{N+2}$. Gate driver 13 may be configured by any of a complementary metal-oxide semiconductor (CMOS) transistor, an N-type channel transistor, and a P-type channel transistor.

The plurality of driver circuits $D_1$ to $D_{N+2}$ respectively output control signals g_out(1) to g_out(N+2). Control signals g_out(1) to g_out(N) are respectively input to control signal lines ini(1) to ini(N). In other words, control signal g_out(i) output by driver circuit $D_i$ of the i-th stage is input to control signal line ini(i). In addition, control signals g_out(2) to g_out(N+1) are respectively input to control signal lines ref(1) to ref(N). In other words, control signal g_out(i+1) output by driver circuit $D_{i+1}$ of the (i+1)th stage is input to control signal line ref(i). In addition, control signals g_out(3) to g_out(N+2) are respectively input to control signal lines ws(1) to ws(N). In other words, control signal g_out(i+2) output by driver circuit $D_{i-2}$ of the (i+2)th stage is input to control signal line ws(i).

As illustrated in FIG. 4, a clock pulse is input to each of driver circuits $D_1$ to $D_{N+2}$. According to the present embodiment, a clock pulse is input for each horizontal cycle of a video signal input to display device 1.

As illustrated in FIG. 3, a start pulse is input as input signal g_in(1) to driver circuit $D_1$ of the first stage. According to the present embodiment, driver circuit $D_1$ of the first stage outputs control signal g_out(1) to control signal line ini(1). Control signal g_out(1) output by driver circuit $D_1$ of the first stage is input as input signal g_in(2) to driver circuit $D_2$ of the second stage. Hereafter, in the same manner as above, driver circuit $D_i$ of the i-th stage outputs control signal g_out(i) to control signal line ini(i), and control signal g_out(i) output by driver circuit $D_i$ of the i-th stage is input as input signal g_in(i+1) to driver circuit $D_{i-1}$ of the (i+1)th stage.

As illustrated in FIG. 5, when a clock signal input through terminal CLK rises (i.e., changes from a low (L) level to a high (H) level) while start pulse SP at the H level is input through terminal D of driver circuit $D_1$ of the first stage, control signal g_out(1) output through terminal Q changes from the L level to the H level. Then, control signal g_out(1) is maintained at the H level until the clock signal rises next.

Since control signal g_out(1) is input through terminal D of driver circuit $D_2$ of the second stage, when a clock signal input through terminal CLK of driver circuit $D_2$ of the second stage rises while control signal g_out(1) is at the H level, control signal g_out(2) output through terminal Q of driver circuit $D_2$ of the second stage changes from the L level to the H level. Driver circuits $D_3$ to $D_{N+2}$ of the third and subsequent stages operate in the same manner as driver circuit $D_2$. In this manner, control signals g_out(1) to g_out(N+2) each including a driving pulse synchronized with the clock signal as illustrated in FIG. 5 are output from gate driver 13. As described above, one driving pulse is input per vertical cycle from gate driver 13 to initialization transistor $T1_R$ included in each of the plurality of rows included in the plurality of pixel circuits 10. One driving pulse is input to each of write transistor $T3_R$ and reference transistor $T2_R$. The one driving pulse is input to initialization transistors $T1_R$ included in mutually different rows among the plurality of rows. The mutually different rows are other than a row in which write transistor $T3_R$ and reference transistor $T2_R$ are included. It should be noted that the driving pulse input to write transistor $T3_R$ included in the (N−1)th row and reference transistor $T2_R$ and write transistor $T3_R$ included in N-th row is not input to initialization transistor $T1_R$ included in the other rows. As described above, a driving pulse input to reference transistor $T2_R$ and write transistor $T3_R$ included in some of the rows among the plurality of pixel circuits 10 need not be input to initialization transistor $T1_R$ included in the other rows.

According to the present embodiment, gate driver 13 outputs control signals g_out(N+1) and g_out(N+2) respectively input to control signal lines ref(N) and ws(N) of the plurality of pixel circuits 10 of the N-th row.

It should be noted that, although the present embodiment describes an example in which gate driver 13 outputs a control signal including a driving pulse having a pulse width of one horizontal cycle, the width of the driving pulse included in a control signal is not limited to one horizontal cycle. For example, the width of the driving pulse included in a control signal may be less than one horizontal cycle.

1-3. Driving Method

Figure 6:
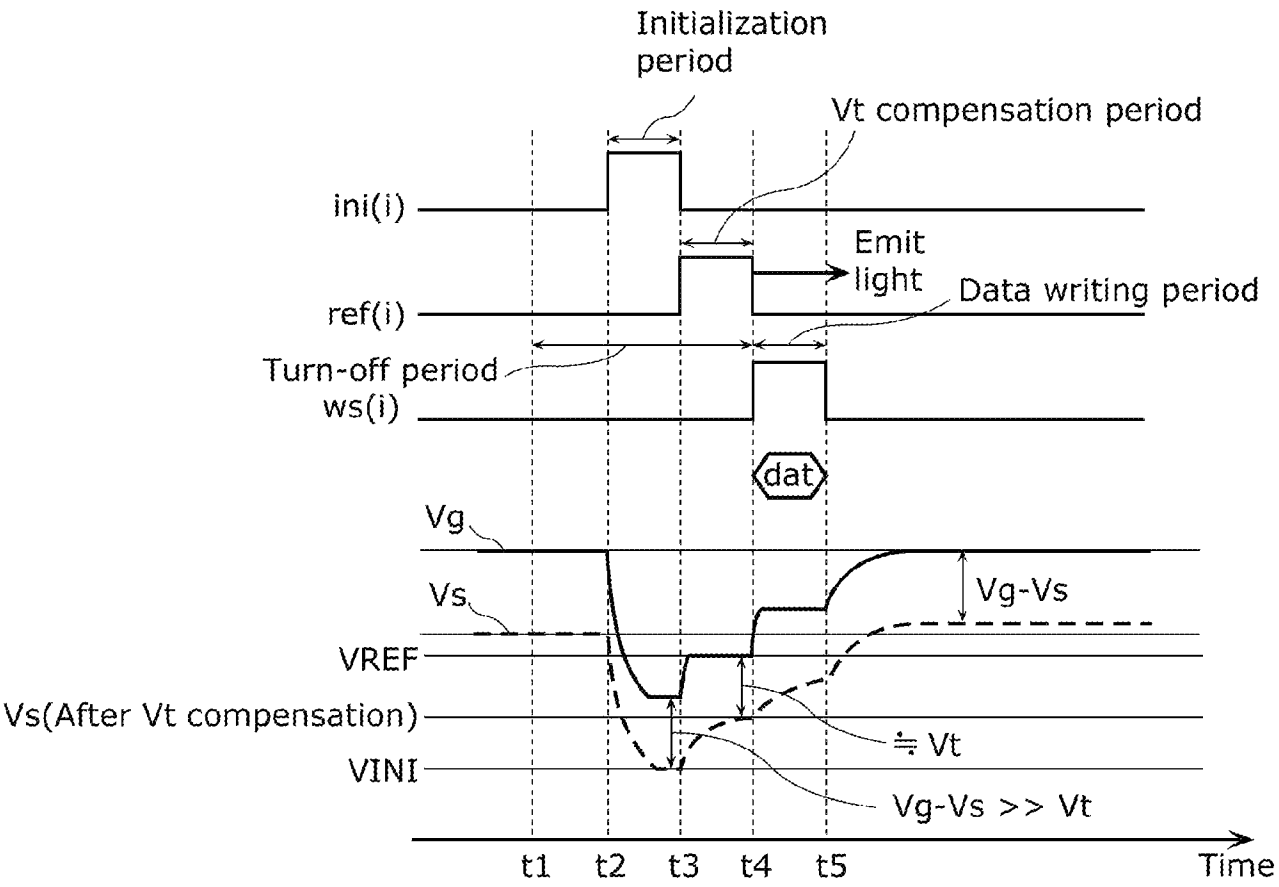
FIG. 6 is a timing chart schematically illustrating a relationship between each of the control signals and a source potential and a gate potential of a driving transistor in a subpixel circuit of the display device according to Embodiment 1.
Figure 7:
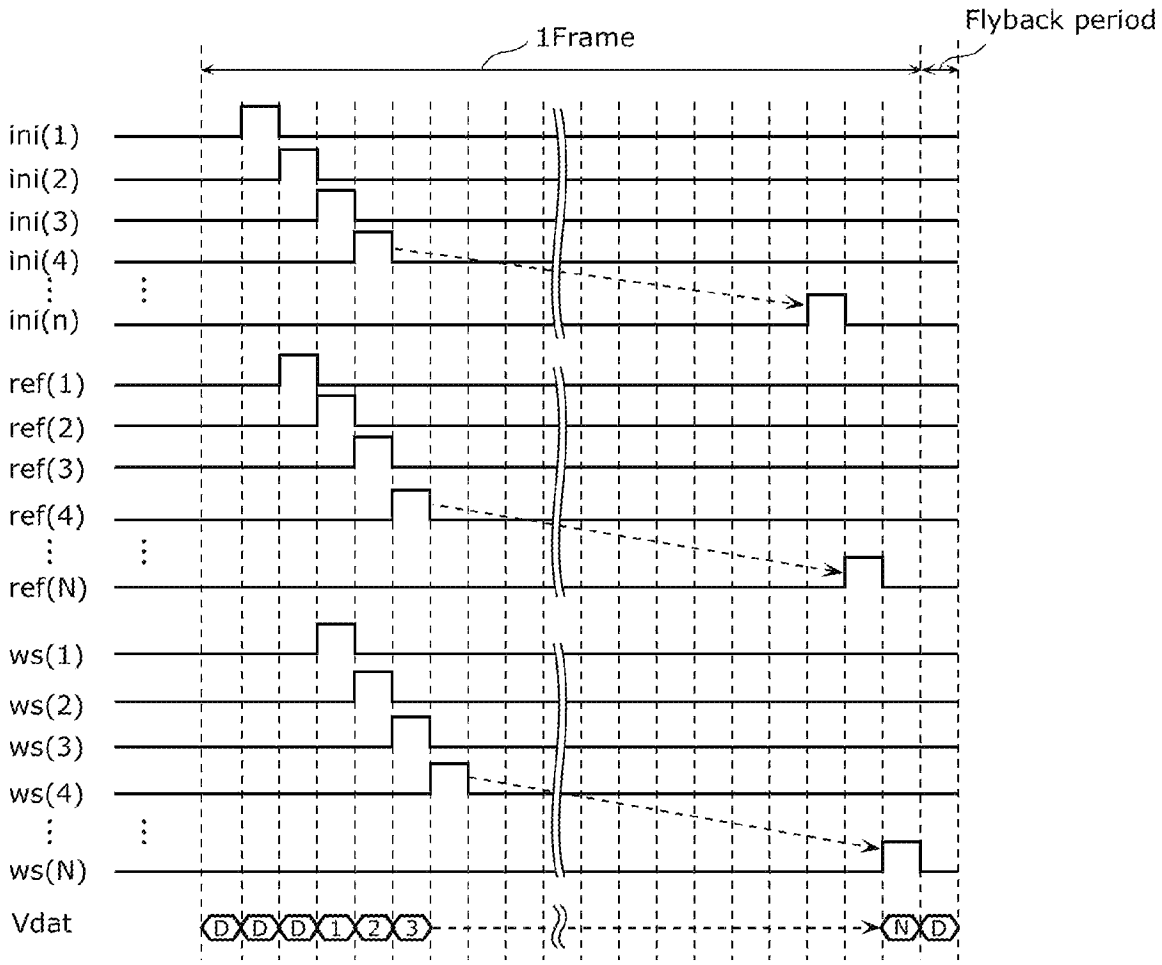
FIG. 7 is a timing chart illustrating a driving pulse that is input to each of the control signal lines of the display device according to Embodiment 1.

Next, a driving method for display device 1 according to the present embodiment will be described with reference to FIG. 6 and FIG. 7. FIG. 6 is a timing chart schematically illustrating a relationship between each of the control signals and a source potential and a gate potential of driving transistor $TD_R$ in subpixel circuit 11R of display device 1 according to the present embodiment. In FIG. 6, each potential, etc. in subpixel circuit 11R included in pixel circuit 10 located in the i-th row among the plurality of pixel circuits 10 arranged in a matrix are indicated. FIG. 7 is a timing chart illustrating a driving pulse that is input to each of the control signal lines of display device 1 according to the present embodiment.

As illustrated in FIG. 6, the control signals are each at the L level from time t1 to time t2, and light emitting element $EL_R$ is in a luminescent state that corresponds to a data signal in an immediately preceding vertical cycle.

Next, at time t2, a driving pulse is input to control signal line ini(i). As a result, the control signal input to control signal line ini(i) is at the H level from time t2 to time t3. In display device 1 according to the present embodiment, gate driver 13 outputs one driving pulse that corresponds to each of the plurality of rows included in the plurality of pixel circuits 10. Control signal g_out(i) from driver circuit $D_i$ of the i-th stage of gate driver 13 is input to control signal line ini(i) of subpixel circuit 11R included in pixel circuit 10 located in the i-th row, and control signal g_out(i) is at the H level from time t2 to time t3. This turns ON the conduction state between the source electrode and the drain electrode of initialization transistor $T1_R$, and thus the anode electrode of light emitting element $EL_R$ is connected to initialization potential line Lini. As a result, the potential of the anode electrode of light emitting element $EL_R$ and potential Vs of the source electrode of driving transistor $TD_R$ become equal to initialization potential VINI. Here, initialization potential VINI is, for example, approximately −2 V. The potential of the anode electrode of light emitting element $EL_R$ and potential Vs of the source electrode of driving transistor $TD_R$ decrease from a potential of approximately +1 V or more to a potential of approximately −2 V from time t2 to time t3. As a result, potential Vg of the gate electrode of driving transistor $TD_R$ also decreases.

As described above, when the control signals input to control signal line ini(i) are at the L level and the H level, initialization transistor $T1_R$ enters an OFF state and an ON state, respectively. Here, initialization potential VINI is applied to the source electrode of initialization transistor $T1_R$. When the control signal is at the L level, in order to place initialization transistor $T1_R$ in the OFF state, the L level of the control signal; that is, the L level of a driving pulse is set to a potential lower than initialization potential VINI. In display device 1 according to the present embodiment, control signals g_out(1) to g_out(N) are respectively input to control signal lines ini(1) to ini(N), and thus the L level of each of control signals g_out(1) to g_out(N) is set to a potential lower than initialization potential VINI. According to the present embodiment, the L level and the H level of control signals g_out(1) to g_out(N+2) are respectively set to, for example, approximately −4 V and approximately 10 V.

It should be noted that, according to the present embodiment, during the initialization period from time t2 to time t3, a relatively large ON current flows in driving transistor $TD_R$, which may cause a voltage drop in initialization potential line Lini. In view of the above, a potential applied to initialization potential line Lini may be increased by the amount of the voltage drop.

Next, at time t3, the control signal input to control signal line ini(i) turns to the L level, and a driving pulse is input to control signal line ref(i). As a result, the control signal input to control signal line ref(i) is at the H level from time t3 to time t4. In other words, the control signal g_out(i+1) from driver circuit $D_{i+1}$ of the (i+1)th stage of gate driver 13 turns to the H level. This turns ON the conduction state between the source electrode and the drain electrode of reference transistor $T2_R$. As a result, the potential of the gate electrode of driving transistor $TD_R$ and the potential of one electrode of storage capacitor $CS_R$ become equal to the reference potential VREF. Here, reference potential VREF is approximately +1 V, for example. This makes it possible to perform threshold compensation on driving transistor $TD_R$. In other words, the difference between gate potential Vg and source potential Vs of driving transistor $TD_R$, namely Vg−Vs, is equal to threshold Vt. The period from time t3 to time t4 is a Vt compensation period.

Next, at time t4, the control signal input to control signal line ref(i) turns to the L level, and a driving pulse is input to control signal line ws(i). As a result, the control signal input to control signal line ws(i) is at the H level from time t4 to time t5. In other words, control signal g_out(i+2) from driver circuit $D_{i+2}$ of the (i+2)th stage of gate driver 13 turns to the H level. This turns ON the conduction state between the source electrode and the drain electrode of write transistor $T3_R$. As a result, the potential of the gate electrode of driving transistor $TD_R$ and the potential of one electrode of storage capacitor $CS_R$ become equal to the voltage of the data signal applied to data signal line Ldr(j). In other words, the period from time t4 to time t5 is a data writing period. As described above, as a result of the voltage corresponding to the data signal being stored in storage capacitor $CS_R$, driving transistor $TD_R$ supplies, to light emitting element $EL_R$, the current corresponding to the data signal. Accordingly, light emitting element $EL_R$ emits light at a luminance corresponding to the data signal. The operation is also performed for the other subpixel circuits 11G and 11B in the same way as subpixel circuit 11R.

As described above, the method of driving display device 1 according to the present embodiment includes: inputting one driving pulse per vertical cycle from gate driver 13 to initialization transistor $T1_R$ included in each of the plurality of rows included in the plurality of pixel circuits 10; and inputting one driving pulse to each of write transistor $T3_R$ and reference transistor $T2_R$, the one driving pulse being input to initialization transistors $T1_R$ included in mutually different rows among the plurality of rows. The mutually different rows are other than a row in which write transistor $T3_R$ and reference transistor $T2_R$ are included.

More specifically, as illustrated in FIG. 7, control signal g_out(i) from driver circuit $D_i$ of the i-th stage of gate driver 13 is input to control signal line ini(i) of each of the subpixel circuits included in pixel circuit 10 located in the i-th row. Control signal g_out(i+1) from driver circuit $D_{i-1}$ of the (i+1)th stage of gate driver 13 is input to control signal line ref(i). Control signal g_out(i+2) from driver circuit $D_{i+2}$ of the (i+2)th stage of gate driver 13 is input to control signal line ws(i). It should be noted that, as illustrated in FIG. 7, gate driver 13 outputs a driving pulse during the period corresponding to one frame in the vertical cycle, and does not output a driving pulse in the flyback period.

With the method of driving as described above, it is possible to drive each of the subpixel circuits by gate driver 13 including the shift register of one system.

1-4. Advantageous Effects

Figure 8:
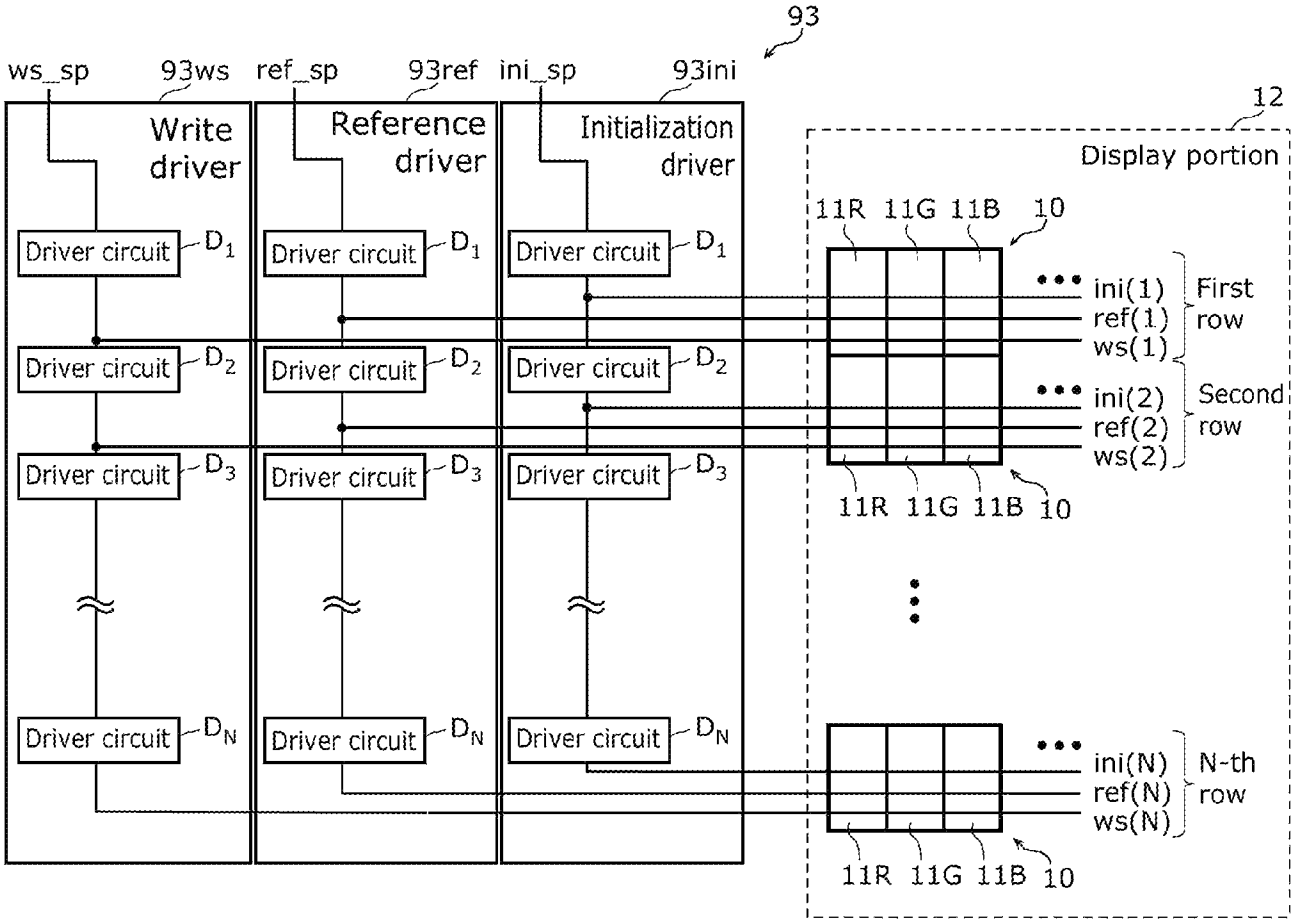
FIG. 8 is a block diagram illustrating a functional configuration of a gate driver of a display device according to Comparison example 1.

Next, advantageous effects of display device 1 and the method of driving display device 1 according to the present embodiment will be described in comparison to a display device according to Comparison example 1, with reference to FIG. 8. FIG. 8 is a block diagram illustrating a functional configuration of gate driver 93 of the display device according to Comparison example 1.

A control signal equivalent to the control signal inputted to each of the control signal lines of display portion 12 according to the present embodiment is input to each of the control signal lines of display portion 12 of the display device according to Comparison example 1. However, in the display device according to Comparison example 1, the configuration of gate driver 93 is different from the configuration of gate driver 13 according to the present embodiment. Gate driver 93 according to Comparison example 1 includes initialization driver 93ini that outputs a control signal to control signal line ini(i) of each row of a plurality of pixel circuits 10, reference driver 93ref that outputs a control signal to control signal line ref(i), and write driver 93*ws* that outputs a control signal to control signal line ws(i).

Initialization driver 93ini includes N driver circuits $D_1$ to $D_N$ connected in cascade in a row, and start pulse ini_sp is input to driver circuit $D_1$ of the first stage. According to this configuration, initialization driver 93ini sequentially outputs N driving pulses. Reference driver 93ref includes N driver circuits $D_1$ to $D_N$ connected in cascade in a row, and start pulse ref_sp is input to driver circuit $D_1$ of the first stage. According to this configuration, reference driver 93ref sequentially outputs N driving pulses. Write driver 93*ws* includes N driver circuits $D_1$ to $D_N$ connected in cascade in a row, and start pulse ws_sp is input to driver circuit $D_1$ of the first stage. According to this configuration, write driver 93*ws* sequentially outputs N driving pulses.

With the display device of Comparative example 1 that includes gate driver 93 as described above, it is also possible to drive a plurality of pixel circuits 10 in the same way as display device 1 according to the present embodiment. However, gate driver 93 has a shift register of three systems. In contrast, gate driver 13 according to the present embodiment includes shift register of one system, and thus display device 1 according to the present embodiment allows the configuration of gate driver 13 to be simplified. As a result, it is possible to reduce the circuits located in the periphery of display portion 12 of display device 1 to approximately one third. As a result, it is possible to narrow the display frame of display device 1. In addition, it is possible to enhance the design of display device 1. Furthermore, since the configuration of gate driver 13 can be simplified, it is possible to reduce the costs of display device 1. In addition, since the configuration of gate driver 13 can be simplified, it is possible to reduce malfunction of display device 1 due to gate driver 13. As a result, it is possible to improve yield of display device 1.

Embodiment 2

The following describes a display device and a method of driving the display device according to Embodiment 2. The display device according to the present embodiment is different from display device 1 in that not only the driving pulse for the Vt compensation but also a driving pulse for turning OFF each of the light emitting elements is input to control signal line ref(i). Hereinafter, the display device and the method of driving the display device according to the present embodiment will be described focusing on the differences from display device 1 and the method of driving display device 1 according to Embodiment 1.

2-1. Gate Driver Configuration

Figure 9:
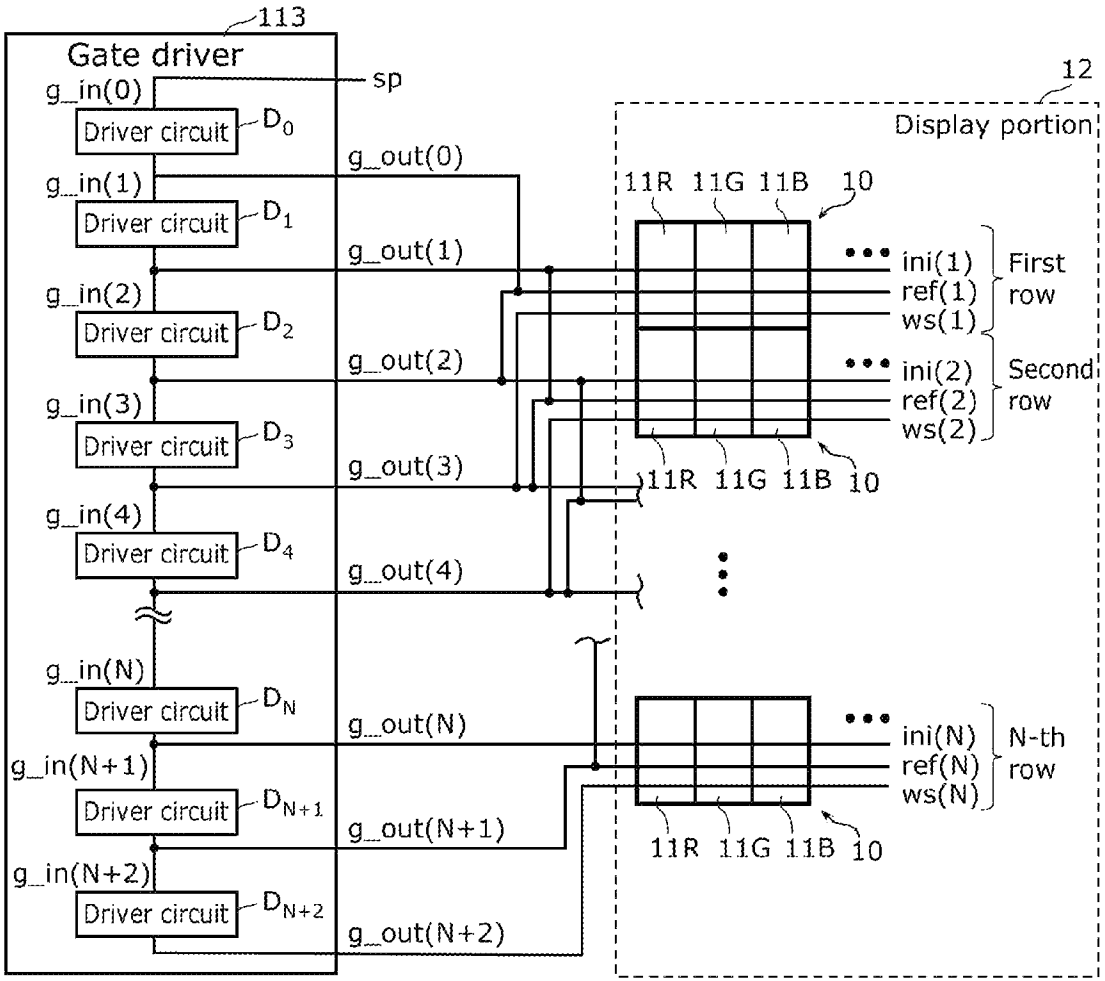
FIG. 9 is a block diagram illustrating a functional configuration of a gate driver according to Embodiment 2.

First, a gate driver included in the display device according to the present embodiment will be described with reference to FIG. 9. FIG. 9 is a block diagram illustrating a functional configuration of gate driver 113 according to the present embodiment. In FIG. 9, display portion 12 is also illustrated.

As illustrated in FIG. 9, gate driver 113 is a shift register of one system which includes N+3 driver circuits $D_0$ to $D_{N+2}$ connected in cascade in a row. The plurality of driver circuits $D_0$ to $D_{N+2}$ each have a configuration equivalent to the configuration of each of the driver circuits according to Embodiment 1. The plurality of driver circuits $D_0$ to $D_{N+2}$ respectively output control signals g_out(0) to g_out(N+2). Gate driver 113 according to the present embodiment outputs control signals g_out(0) to g_out(N+2) each including a driving pulse synchronized with a clock pulse, as with gate driver 13 according to Embodiment 1.

Control signals g_out(0) to g_out(N−1) are respectively input to control signal lines ref(1) to ref(N). In other words, control signal g_out(i−1) output by driver circuit $D_{i-1}$ of the (i−1)th stage is input to control signal line ref(i) ($1 \leq I \leq N$). In addition, control signals g_out(1) to g_out(N) are respectively input to control signal lines ini(1) to ini(N). In other words, control signal g_out(i) output by driver circuit $D_i$ of the i-th stage is input to control signal line ini(i). In addition, control signals g_out(2) to g_out(N+1) are respectively input to control signal lines ref(1) to ref(N). In other words, control signal g_out(i+1) output by driver circuit $D_{i+1}$ of the (i+1)th stage is input to control signal line ref(i). In addition, control signals g_out(3) to g_out(N+2) are respectively input to control signal lines ws(1) to ws(N). In other words, control signal g_out(i+2) output by driver circuit $D_{i+2}$ of the (i+2)th stage is input to control signal line ws(i).

2-2. Driving Method

Figure 10:
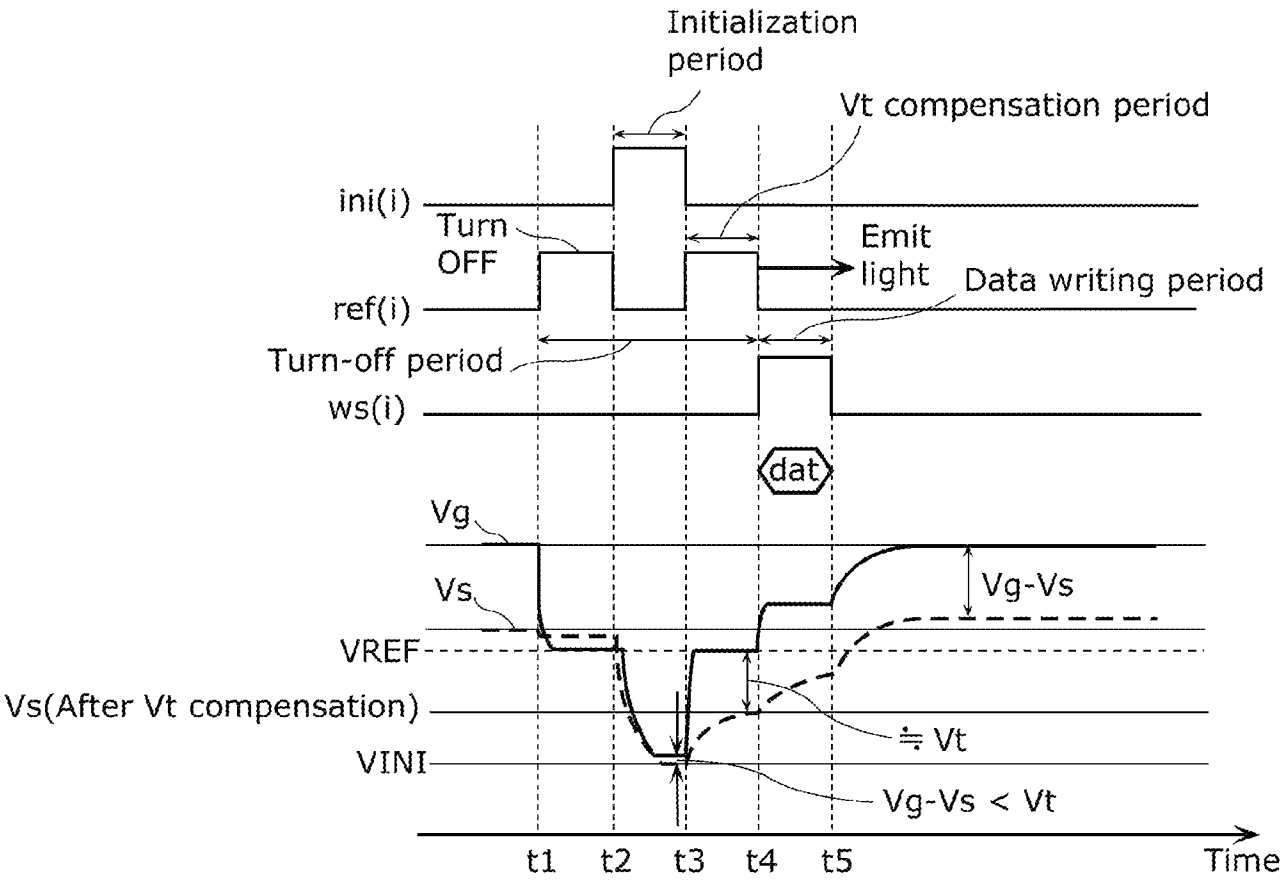
FIG. 10 is a timing chart schematically illustrating a relationship between each of the control signals and a source potential and a gate potential of a driving transistor in a subpixel circuit of the display device according to Embodiment 2.
Figure 11:
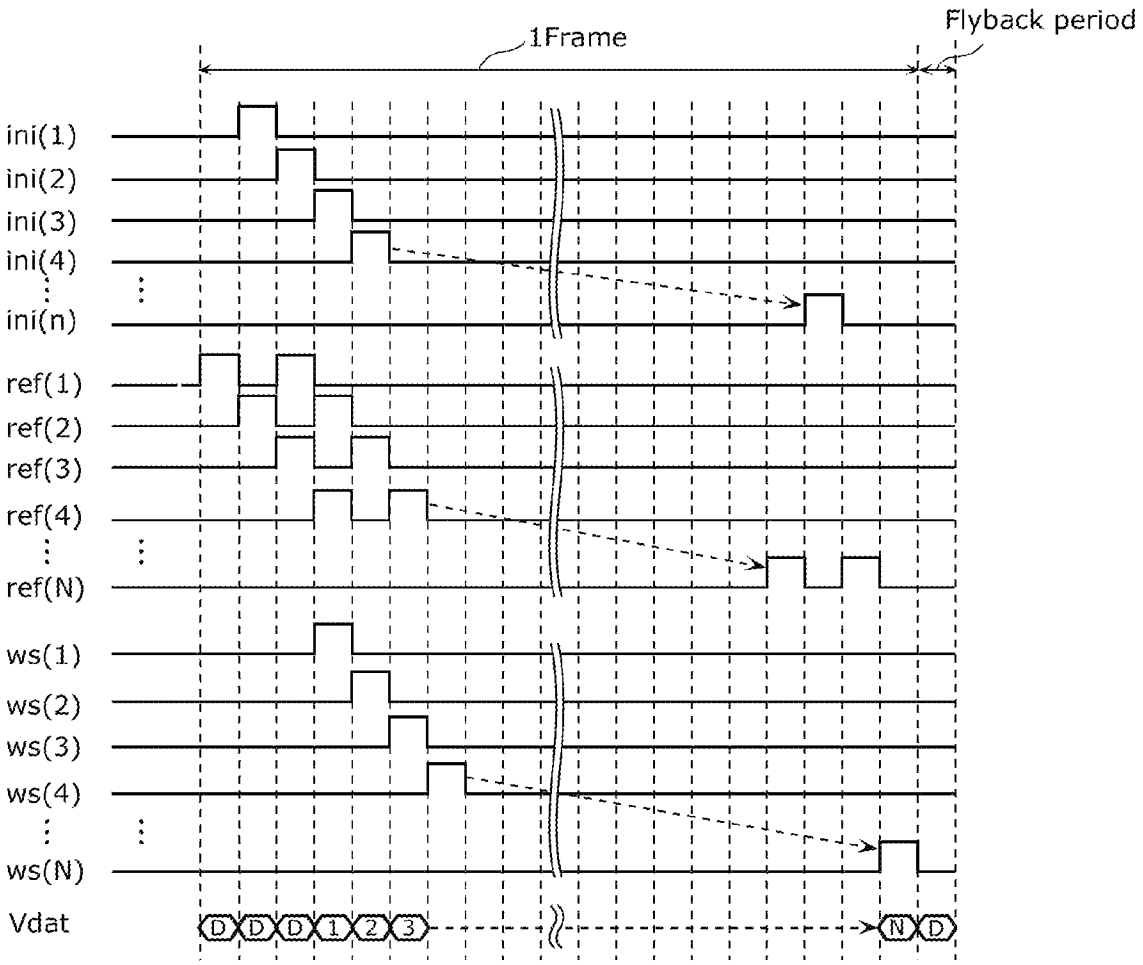
FIG. 11 is a timing chart illustrating a driving pulse that is input to each of the control signal lines of the display device according to Embodiment 2.

Next, a method of driving the display device according to the present embodiment will be described with reference to FIG. 10 and FIG. 11. FIG. 10 is a timing chart schematically illustrating a relationship between each of the control signals and a source potential and a gate potential of driving transistor $TD_R$ in subpixel circuit 11R of the display device according to the present embodiment. In FIG. 10, each potential, etc. in subpixel circuit 11R included in pixel circuit 10 located in the i-th row among the plurality of pixel circuits 10 arranged in a matrix are indicated. FIG. 11 is a timing chart illustrating a driving pulse that is input to each of the control signal lines of the display device according to the present embodiment.

As illustrated in FIG. 10, the control signals are each at the L level until time t1, and light emitting element $EL_R$ is in a luminescent state that corresponds to a data signal in an immediately preceding vertical cycle.

Next, at time t1, a driving pulse is input to control signal line ref(i). As a result, the control signal that is input is at the H level from time t1 to time t2. In other words, the control signal g_out(i−1) from driver circuit $D_{i-1}$ of the (i−1)th stage of gate driver 113 turns to the H level. This turns ON the conduction state between the source electrode and the drain electrode of reference transistor $T2_R$. As a result, the potential of the gate electrode of driving transistor $TD_R$ and the potential of one electrode of storage capacitor $CS_R$ become equal to the reference potential VREF. Here, reference potential VREF is approximately +1 V, for example. According to the above-described configuration, light emitting element $EL_R$ is turned OFF. In other words, the driving pulse input to control signal line ref(i) at time t1 is a turn-off pulse. According to the present embodiment, the turn-off pulse is input to control signal line ref(i), and thus it is possible to set the difference between gate potential Vg and source potential Vs of driving transistor $TD_R$, namely Vg−Vs, to be smaller than threshold Vt. For that reason, it is possible to inhibit the voltage drop of the initialization potential line which is caused by an ON current flowing through driving transistor $TD_R$.

Next, at time t2, the control signal input to control signal line ref(i) turns to the L level, and a driving pulse is input to control signal line ini(i). Accordingly, the control signal input to control signal line ini(i) is at the H level from time t2 to time t3. Control signal g_out(i) from driver circuit Di of the i-th stage of gate driver 113 is input to control signal line ini(i) of subpixel circuit 11R included in pixel circuit 10 located in the i-th row, and control signal g_out(i) is at the H level from time t2 to time t3. This turns ON the conduction state between the source electrode and the drain electrode of initialization transistor $T1_R$, and thus the anode electrode of light emitting element $EL_R$ is connected to initialization potential line Lini. As a result, the potential of the anode electrode of light emitting element $EL_R$ and potential Vs of the source electrode of driving transistor $TD_R$ become equal to initialization potential VINI. Here, initialization potential VINI is, for example, approximately −2 V. The potential of the anode electrode of light emitting element $EL_R$ and the potential Vs of the source electrode of driving transistor $TD_R$ decrease from a potential of approximately +1 V or more to a potential of approximately −2 V from time t2 to time t3. As a result, potential Vg of the gate electrode of driving transistor $TD_R$ also decreases.

Next, at time t3, the control signal input to control signal line ini(i) turns to the L level, and a driving pulse is input to control signal line ref(i). As a result, the control signal input to control signal line ref(i) is at the H level from time t3 to time t4. In other words, the control signal g_out(i+1) from driver circuit $D_{i+1}$ of the (i+1)th stage of gate driver 113 turns to the H level. This turns ON the conduction state between the source electrode and the drain electrode of reference transistor $T2_R$. As a result, the potential of the gate electrode of driving transistor $TD_R$ and the potential of one electrode of storage capacitor $CS_R$ become equal to the reference potential VREF. Here, reference potential VREF is approximately +1 V, for example. This makes it possible to perform threshold compensation of driving transistor $TD_R$. In other words, the difference between gate potential Vg and source potential Vs of driving transistor $TD_R$, namely Vg−Vs, is equal to threshold Vt.

Next, at time t4, the control signal input to control signal line ref(i) turns to the L level, and a driving pulse is input to control signal line ws(i). As a result, the control signal input to control signal line ws(i) is at the H level from time t4 to time t5. In other words, the control signal g_out(i+2) from driver circuit $D_{i+2}$ of the (i+2)th stage of gate driver 113 turns to the H level. This turns ON the conduction state between the source electrode and the drain electrode of write transistor $T3_R$. As a result, the potential of the gate electrode of driving transistor $TD_R$ and the potential of one electrode of storage capacitor $CS_R$ become equal to the voltage of the data signal applied to data signal line Ldr(j). In other words, the period from time t4 to time t5 is a data writing period. As described above, as a result of the voltage corresponding to the data signal being stored in storage capacitor $CS_R$, driving transistor $TD_R$ supplies, to light emitting element $EL_R$, the current corresponding to the data signal. Accordingly, light emitting element $EL_R$ emits light at a luminance corresponding to the data signal. The operation is also performed on the other subpixel circuits 11G and 11B in the same way as subpixel circuit 11R.

As described above, the method of driving the display device according to the present embodiment includes: inputting one driving pulse per vertical cycle from gate driver 113 to initialization transistor $T1_R$ included in each of the plurality of rows included in the plurality of pixel circuits 10; and inputting one driving pulse to each of write transistor $T3_R$ and reference transistor $T2_R$, the one driving pulse being input to initialization transistors $T1_R$ included in mutually different rows among the plurality of rows. The mutually different rows are other than a row in which write transistor $T3_R$ and reference transistor $T2_R$ are included. More specifically, as illustrated in FIG. 11, control signal g_out(i) from driver circuit Di of the i-th stage of gate driver 113 is input to control signal line ini(i) of each subpixel circuit included in pixel circuit 10 located in the i-th row. Control signal g_out(i−1) from driver circuit $D_{i-1}$ of the (i−1)th stage of gate driver 113 and control signal g_out(i+1) from driver circuit $D_{i+1}$ of the (i+1)th stage of gate driver 113 are input to control signal line ref(i). Control signal g_out(i+2) from driver circuit $D_{i+2}$ of the (i+2)th stage of gate driver 113 is input to control signal line ws(i).

With the method of driving as described above, it is possible to drive each of the subpixel circuits by gate driver 113 including the shift register of one system.

2-3. Advantageous Effects

The following describes advantageous effects of the display device and the method of driving the display device according to the present embodiment. With the display device and the method of driving the display device according to the present embodiment, it is possible to yield advantageous effects equivalent to the advantageous effects of Embodiment 1. In addition, according to the present embodiment, one driving pulse corresponding to each of two mutually different rows of the plurality of pixel circuits 10 is input per vertical cycle to the reference transistor of each of the subpixel circuits. According to the above-described configuration, it is possible to enhance the degree of freedom in a driving mode of each of the subpixel circuits. More specifically, a first driving pulse is input to reference transistor $T2_R$ of subpixel circuit 11R after a second driving pulse is input to initialization transistor $T1_R$ and before a third driving pulse is input to write transistor $T3_R$ for the first time, and a fourth driving pulse is input to reference transistor $T2_R$ of subpixel circuit 11R after the third driving pulse is input to write transistor $T3_R$ and before a fifth driving pulse is input to initialization transistor $T1_R$ for the first time, each of the first driving pulse, the second driving pulse, the third driving pulse, the fourth driving pulse, and the fifth driving pulse being the one driving pulse.

In this manner, it is possible to provide a turn-off period before an initialization period, by inputting a driving pulse to reference transistor $T2_R$ before the initialization period. Accordingly, since the gate potential of driving transistor $TD_R$ can be reduced to approximately the reference potential before the initialization period, it is possible to reduce the ON current of driving transistor $TD_R$ in the initialization period. This allows the voltage drop of the initialization potential line to be reduced.

Embodiment 3

The following describes a display device and a method of driving the display device according to Embodiment 3. The display device according to the present embodiment is different from display device 1 according to Embodiment 1 in that a gate driver outputs a plurality of driving pulses for Vt compensation to control signal line ref(i). Hereinafter, the display device and the method of driving the display device according to the present embodiment will be described focusing on the differences from display device 1 and the method of driving display device 1 according to Embodiment 1.

3-1. Gate Driver Configuration

Figure 12:
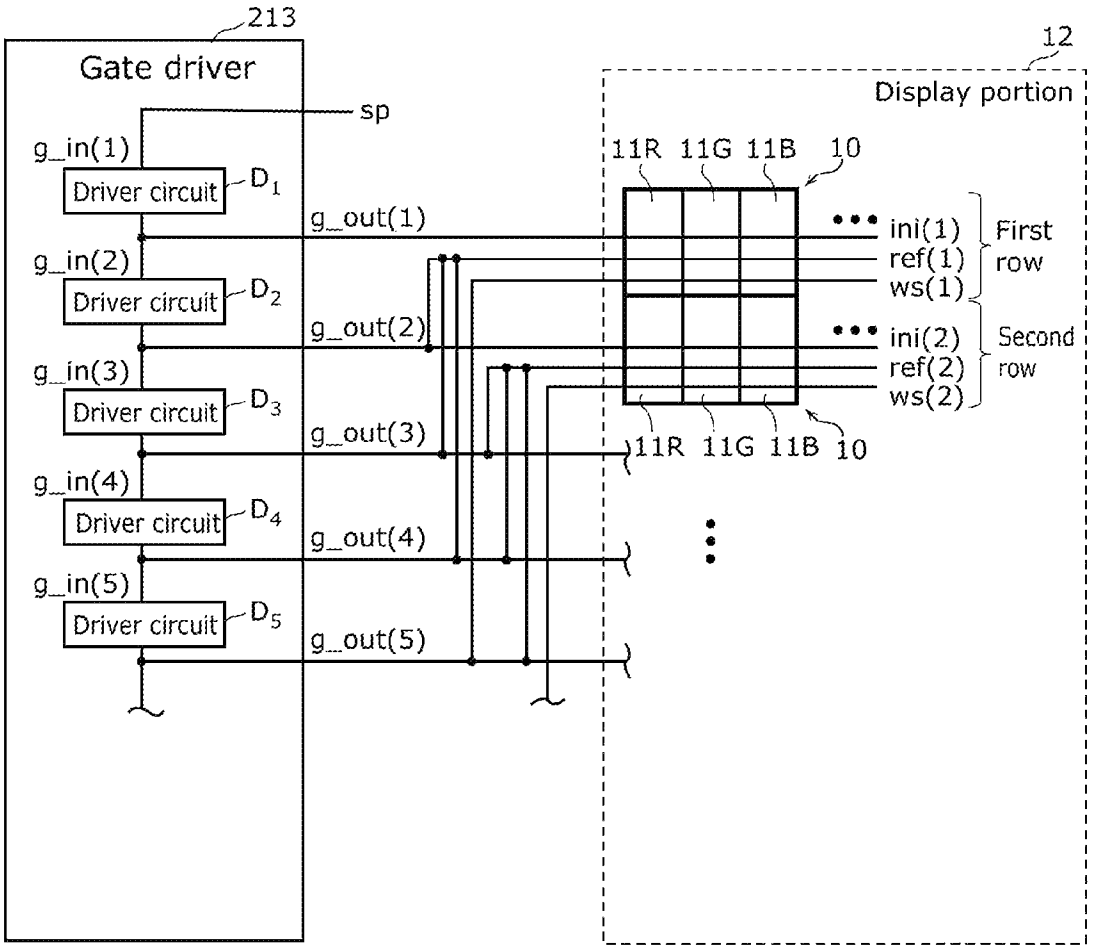
FIG. 12 is a block diagram illustrating a functional configuration of a gate driver according to Embodiment 3.

First, a gate driver included in the display device according to the present embodiment will be described with reference to FIG. 12. FIG. 12 is a block diagram illustrating a functional configuration of gate driver 213 according to the present embodiment. In FIG. 12, display portion 12 is also illustrated.

As illustrated in FIG. 12, gate driver 213 is a shift register of one system which includes a plurality of driver circuits connected in cascade in a row. According to the present embodiment, gate driver 213 includes N+4 driver circuits $D_1$ to $D_{N+4}$. The plurality of driver circuits $D_1$ to $D_{N+4}$ each have a configuration equivalent to the configuration of each of the driver circuits according to Embodiment 1. The plurality of driver circuits $D_1$ to $D_{N+4}$ respectively output control signals g_out(1) to g_out(N+4). Gate driver 213 according to the present embodiment outputs control signals g_out(1) to g_out(N+4) each including a driving pulse synchronized with a clock pulse, as with gate driver 13 according to Embodiment 1. Gate driver 213 outputs one driving pulse corresponding to each of a plurality of rows included in the plurality of pixel circuits 10 arranged in a matrix.

In addition, control signals g_out(1) to g_out(N) are respectively input to control signal lines ini(1) to ini(N). In other words, control signal g_out(i) output by driver circuit Di of the i-th stage is input to control signal line ini(i). In addition, control signals g_out(2) to g_out(N+1) are respectively input to control signal lines ref(1) to ref(N). In other words, control signal g_out(i+1) output by driver circuit $D_{i+1}$ of the (i+1)th stage is input to control signal line ref(i). In addition, control signals g_out(3) to g_out(N+2) are respectively input to control signal lines ref(1) to ref(N). In other words, control signal g_out(i+2) output by driver circuit $D_{i+2}$ of the (i+2)th stage is also input to control signal line ref(i). In addition, control signals g_out(4) to g_out(N+3) are respectively input to control signal lines ref(1) to ref(N). In other words, control signal g_out(i+3) output by driver circuit $D_{i+3}$ of the (i+3)th stage is also input to control signal line ref(i). In addition, control signals g_out(5) to g_out(N+4) are respectively input to control signal lines ws(1) to ws(N). In other words, control signal g_out(i+4) output by driver circuit $D_{i+4}$ of the (i+4)th stage is input to control signal line ws(i).

3-2. Driving Method

Figure 13:
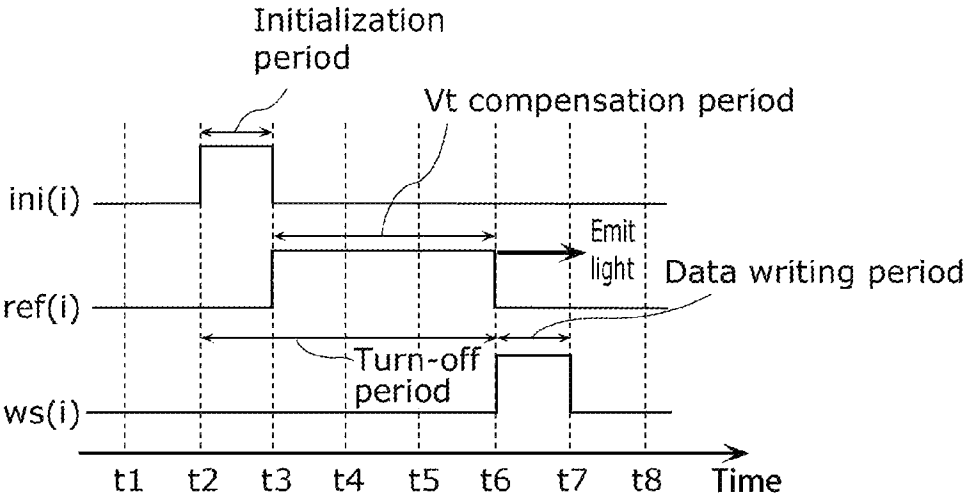
FIG. 13 is a timing chart illustrating a driving pulse that is input to each of the control signal lines in a subpixel circuit of the display device according to Embodiment 3.
Figure 14:
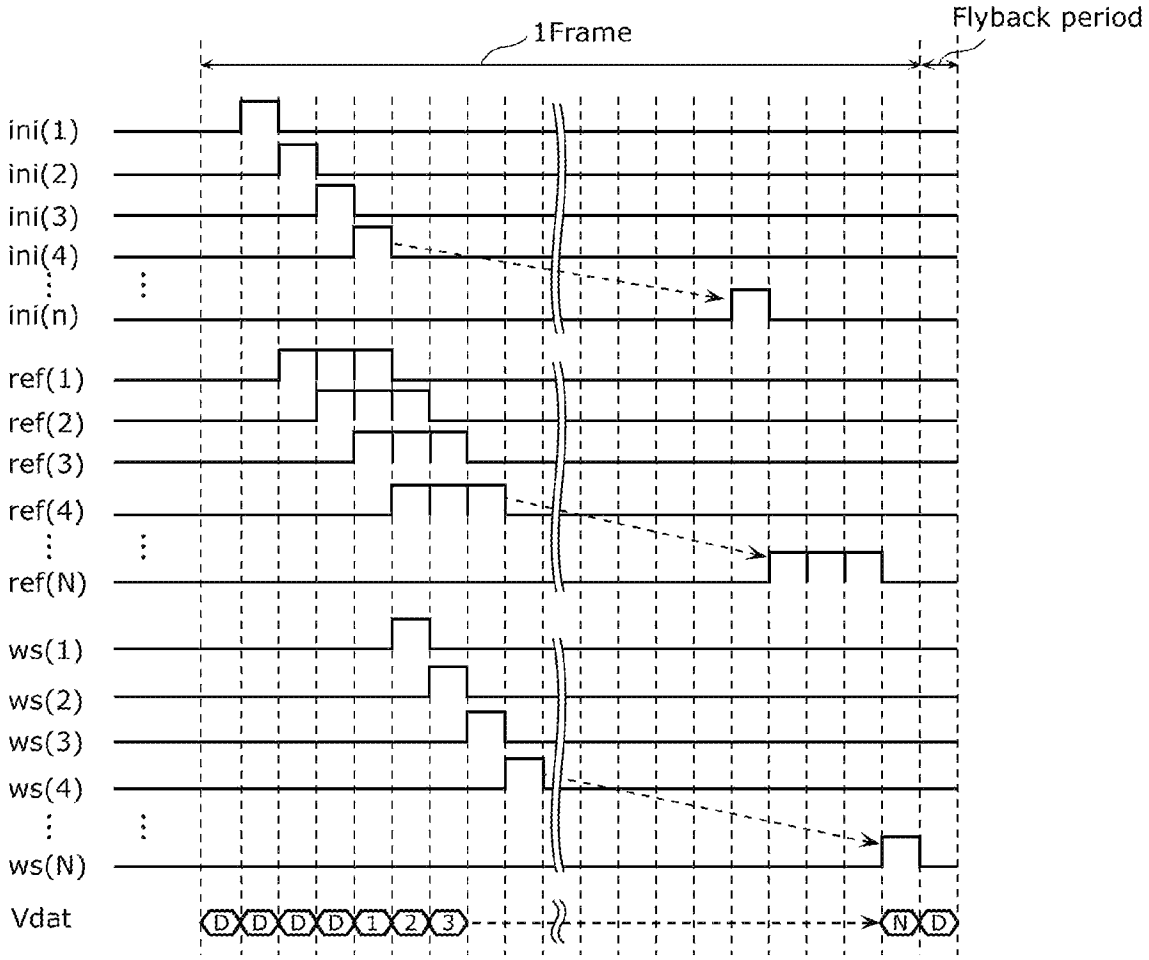
FIG. 14 is a timing chart illustrating a driving pulse that is input to each of the control signal lines of the display device according to Embodiment 3.

Next, a method of driving the display device according to the present embodiment will be described with reference to FIG. 13 and FIG. 14. FIG. 13 is a timing chart illustrating a driving pulse that is input to each of the control signal lines in subpixel circuit 11R of the display device according to the present embodiment. In FIG. 13, a driving pulse input to each of the control signal lines in subpixel circuit 11R included in pixel circuit 10 located in the i-th row among the plurality of pixel circuits 10 arranged in a matrix are indicated. FIG. 14 is a timing chart illustrating a driving pulse that is input to each of the control signal lines of the display device according to the present embodiment.

As illustrated in FIG. 13, a driving pulse equivalent to that of Embodiment 1 is input to subpixel circuit 11R until time t4.

Next, at time t4, control signal g_out(i+1) is at the L level, and the driving pulse of control signal g_out(i+2) is input to control signal line ref(i). As a result, the control signal input to control signal line ref(i) is at the H level from time t4 to time t5. In other words, the control signal g_out(i+2) from driver circuit $D_{i+2}$ of the (i+2)th stage of gate driver 213 is at the H level. Accordingly, the conduction state between the source electrode and the drain electrode of reference transistor $T2_R$ stays ON. In this manner, the Vt compensation period continues until time t5.

Next, at time t5, control signal g_out(i+2) is at the L level, and the driving pulse of control signal g_out(i+3) is input to control signal line ref(i). As a result, the control signal input to control signal line ref(i) is at the H level from time t5 to time t6. In other words, the control signal g_out(i+3) from driver circuit $D_{i+3}$ of the (i+3)th stage of gate driver 213 is at the H level. Accordingly, the conduction state between the source electrode and the drain electrode of reference transistor $T2_R$ stays ON. In this manner, the Vt compensation period continues until time t6.

Next, at time t6, as a result of control signal g_out(i+3) turning to the L level, the control signal input to control signal line ref(i) turns to the L level, and a driving pulse is input to control signal line ws(i). As a result, the control signal input to control signal line ws(i) turns to the H level from time t6 to time t7. In other words, the control signal g_out(i+4) from driver circuit $D_{i+4}$ of the (i+4)th stage of gate driver 213 turns to the H level. This turns ON the conduction state between the source electrode and the drain electrode of write transistor $T3_R$. As a result, the potential of the gate electrode of driving transistor $TD_R$ and the potential of one electrode of storage capacitor $CS_R$ become equal to the voltage of the data signal applied to data signal line Ldr(j). In other words, the period from time t6 to time t7 is a data writing period. As described above, as a result of the voltage corresponding to the data signal being stored in storage capacitor $CS_R$, driving transistor $TD_R$ supplies, to light emitting element $EL_R$, the current corresponding to the data signal. Accordingly, light emitting element $EL_R$ emits light at a luminance corresponding to the data signal. The operation is also performed on the other subpixel circuits 11G and 11B in the same way as subpixel circuit 11R.

As described above, the method of driving the display device according to the present embodiment includes: inputting one driving pulse per vertical cycle from gate driver 213 to initialization transistor $T1_R$ included in each of the plurality of rows included in the plurality of pixel circuits 10; and inputting one driving pulse to each of write transistor $T3_R$ and reference transistor $T2_R$, the one driving pulse being input to initialization transistors $T1_R$ included in mutually different rows among the plurality of rows. The mutually different rows are other than a row in which write transistor $T3_R$ and reference transistor $T2_R$ are included. More specifically, as illustrated in FIG. 14, control signal g_out(i) from driver circuit $D_i$ of the i-th stage of gate driver 213 is input to control signal line ini(i) of each subpixel circuit included in pixel circuit 10 located in the i-th row. Control signal g_out(i+1) from driver circuit $D_{i+1}$ of the (i+1)th stage of gate driver 213, control signal g_out(i+2) from driver circuit $D_{i+2}$ of the (i+2)th stage of gate driver 213, and control signal g_out(i+3) from driver circuit $D_{i+3}$ of the (i+3)th stage of gate driver 213 are input to control signal line ref(i). Control signal g_out(i+4) from driver circuit $D_{i+4}$ of the (i+4)th stage of gate driver 213 is input to control signal line ws(i).

With the method of driving as described above, it is possible to drive each of the subpixel circuits by gate driver 213 including the shift register of one system. It should be noted that, although the Vt compensation period includes three driving pulses according to the present embodiment, the Vt compensation period may include two driving pulses or four or more driving pulses.

3-3. Advantageous Effects

The following describes advantageous effects of the display device and the method of driving the display device according to the present embodiment. With the display device and the method of driving the display device according to the present embodiment, it is possible to yield advantageous effects equivalent to the advantageous effects of Embodiment 1. In addition, according to the present embodiment, one driving pulse corresponding to each of two mutually different rows of the plurality of pixel circuits 10 is input per vertical cycle to the reference transistor of each of the subpixel circuits. According to the above-described configuration, it is possible to enhance the degree of freedom in a driving mode of each of the subpixel circuits. More specifically, a first driving pulse and a second driving pulse respectively corresponding to the two mutually different rows of the plurality of pixel circuits 10 are input to reference transistor $T2_R$ of subpixel circuit 11R, after a third driving pulse is input to initialization transistor $T1_R$ and before a fourth driving pulse is input to write transistor $T3_R$ for the first time, each of the first driving pulse, the second driving pulse, the third driving pulse, and the fourth driving pulse being the one driving pulse.

In this manner, it is possible to cause the Vt compensation period to be longer than the initialization period or the writing period. In addition, it is possible to cause the Vt compensation period to be longer than one horizontal cycle. As a result, it is possible to reliably perform a threshold compensation even when it takes one horizontal cycle or longer to perform the threshold compensation.

Embodiment 4

The following describes a display device and a method of driving the display device according to Embodiment 4. The display device according to the present embodiment is different from display device 1 according to Embodiment 1 in that the gate driver is separated into two gate drivers. Hereinafter, the display device according to the present embodiment will be described focusing on the gate driver that is a point of difference from display device 1 according to Embodiment 1.

4-1. Gate Driver Configuration

Figure 15:
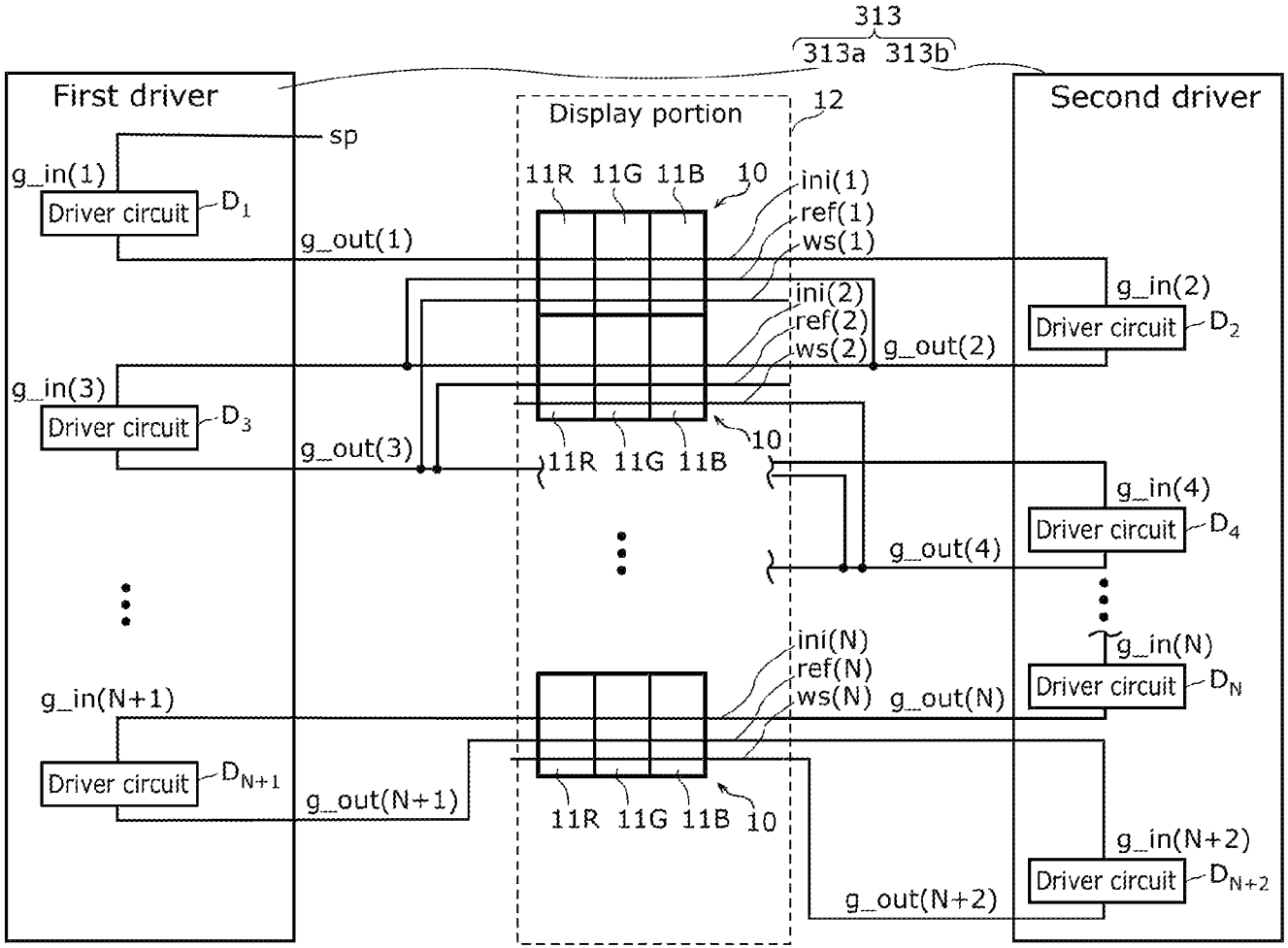
FIG. 15 is a block diagram illustrating a functional configuration of a gate driver according to Embodiment 4.

First, a gate driver included in the display device according to the present embodiment will be described with reference to FIG. 15. FIG. 15 is a block diagram illustrating a functional configuration of gate driver 313 according to the present embodiment. In FIG. 15, display portion 12 is also illustrated.

As illustrated in FIG. 15, gate driver 313 according to the present embodiment includes first driver 313*a* and second driver 313*b*. Each of first driver 313*a* and second driver 313*b* outputs one driving pulse that is input to initialization transistor $T1_R$ included in at least one of the rows of the plurality of pixel circuits 10. First driver 313*a* and second driver 313*b* are separately disposed from each other via control signal lines, and display portion 12 is disposed between first driver 313*a* and second driver 313*b*. According to the present embodiment, first driver 313*a* and second driver 313*b* are spaced apart from each other in the horizontal direction of display portion 12.

According to the present embodiment, first driver 313*a* includes driver circuits $D_1$, $D_3$, . . . , and $D_{N+1}$ which are driver circuits of the odd-numbered stages, and second driver 313*b* includes driver circuits $D_2$, $D_4$, . . . , and $D_{N+2}$ which are driver circuits of the even-numbered stages. Driver circuits $D_1$, $D_3$, . . . , and $D_{N+1}$ of first driver 313*a* respectively output control signals to driver circuits $D_2$, $D_4$, . . . , and $D_{N+2}$ of second driver 313*b*. In addition, driver circuits $D_2$, $D_4$, . . . , and $D_N$ of second driver 313*b* respectively output control signals to driver circuits $D_3$, $D_5$, . . . , and $D_{N+1}$ of first driver 313*a*. In other words, first driver 313*a* and second driver 313*b* form a shift register of one system that is equivalent to gate driver 13 according to Embodiment 1.

In the same manner as Embodiment 1, driver circuits $D_1$ to $D_{N+2}$ respectively output control signals g_out(1) to g_out(N+2) in the present embodiment as well. Control signals g_out(1) to g_out(N) are respectively input to control signal lines ini(1) to ini(N). In addition, control signals g_out(2) to g_out(N+1) are respectively input to control signal lines ref(1) to ref(N). In addition, control signals g_out(3) to g_out(N+2) are respectively input to control signal lines ws(1) to ws(N).

With the configuration as described above, gate driver 313 according to the present embodiment is capable of outputting, to display portion 12, a control signal equivalent to that of gate driver 13 according to Embodiment 1.

It should be noted that, although first driver 313*a* includes the driver circuits of the odd-numbered stages and second driver 313*b* includes the driver circuit of the even-numbered stages according to the present embodiment, the configurations of first driver 313*a* and second driver 313*b* are not limited to these examples. For example, first driver 313*a* may include driver circuits of the first stage, the fourth stage, the fifth stage, the eighth stage, the ninth stage, . . . , and second driver 313*b* may include driver circuits of the second stage, the third stage, the sixth stage, the seventh stage, the tenth stage, . . . . In other words, each of first driver 313*a* and second driver 313*b* may include driver circuits of two consecutive stages.

4-2. Advantageous Effects

With the display device and the method of driving the display device according to the present embodiment, it is possible to yield advantageous effects equivalent to the advantageous effects yielded by display device 1 and the method of driving display device 1 according to Embodiment 1. In addition, according to the present embodiment, gate driver 313 includes first driver 313*a* and second driver 313*b*, and first driver 313*a* and second driver 313*b* each output one driving pulse that is input to initialization transistor $T1_R$ included in at least one of the rows of the plurality of pixel circuits 10, and display portion 12 is disposed between first driver 313*a* and second driver 313*b*.

According to the above-described configuration, it is possible to configure each of the circuits of first driver 313*a* and second driver 313*b*, by including approximately half the total number of elements of gate driver 13 according to Embodiment 1, for example. As a result, it is possible to reduce the width of the display frame of the portion in which first driver 313*a* and second driver 313*b* are disposed, to be less than the width of the display frame of the portion in which gate driver 13 according to Embodiment 1 is disposed. This allows further enhancing the design of the display device.

Embodiment 5

The following describes a display device and a method of driving the display device according to Embodiment 5. The display device according to the present embodiment is different from display device 1 according to Embodiment 1 in that the width of a driving pulse output by the gate driver is longer than one horizontal cycle. Hereinafter, the display device and the method of driving the display device according to the present embodiment will be described focusing on the differences from display device 1 and the method of driving display device 1 according to Embodiment 1.

5-1. Gate Driver Configuration

Figure 16:
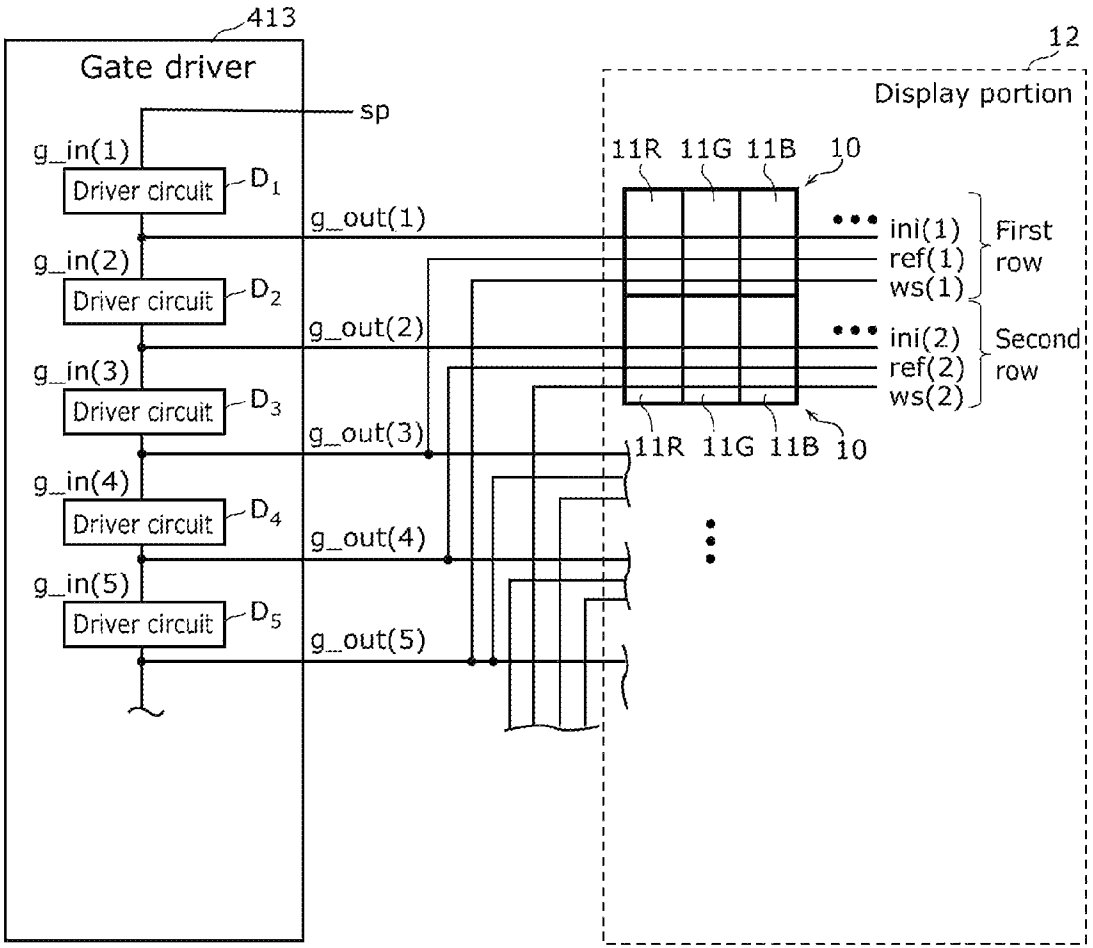
FIG. 16 is a block diagram illustrating a functional configuration of a gate driver according to Embodiment 5.
Figure 17:
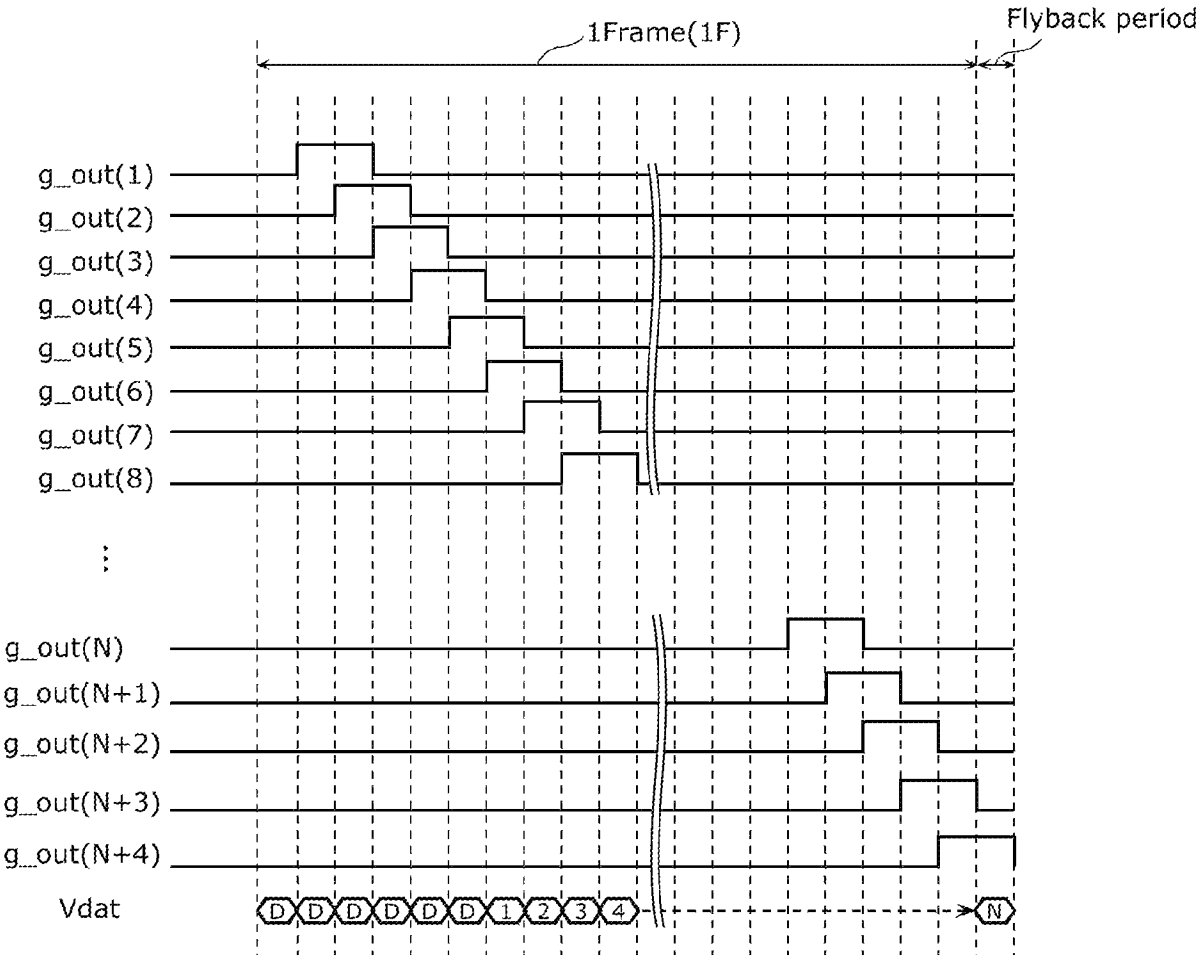
FIG. 17 is a timing chart illustrating a driving pulse that is output by a gate driver according to Embodiment 5.

First, a gate driver included in the display device according to the present embodiment will be described with reference to FIG. 16. FIG. 16 is a block diagram illustrating a functional configuration of gate driver 413 according to the present embodiment. In FIG. 16, display portion 12 is also illustrated. FIG. 17 is a timing chart illustrating a driving pulse that is output by gate driver 413 according to the present embodiment.

As illustrated in FIG. 16, gate driver 413 is a shift register of one system which includes a plurality of driver circuits connected in cascade in a row. According to the present embodiment, gate driver 413 includes N+4 driver circuits $D_1$ to $D_{N+4}$.

The plurality of driver circuits $D_1$ to $D_{N+4}$ each have a configuration equivalent to the configuration of each of the driver circuits according to Embodiment 1. The plurality of driver circuits $D_1$ to $D_{N+4}$ respectively output control signals g_out(1) to g_out(N+4). Gate driver 413 according to the present embodiment outputs control signals g_out(1) to g_out(N+4) each including a driving pulse synchronized with a clock pulse, as with gate driver 13 according to Embodiment 1. According to the present embodiment, the width of each driving pulse is longer than one horizontal cycle as illustrated in FIG. 17. More specifically, the width of each driving pulse corresponds to two horizontal cycles. Gate driver 413 that outputs such a driving pulse can be realized by a shift register using a flip-flop circuit as illustrated in FIG. 4, for example. The width of each driving pulse can be varied, for example, by adjusting the pulse width of start pulse sp.

Control signals g_out(1) to g_out(N) are respectively input to control signal lines ini(1) to ini(N). In other words, control signal g_out(i) output by driver circuit $D_i$ of the i-th stage is input to control signal line ini(i). In addition, control signals g_out(3) to g_out(N+2) are respectively input to control signal lines ref(1) to ref(N). In other words, control signal g_out(i+2) output by driver circuit $D_{i+2}$ of the (i+2)th stage is input to control signal line ref(i). In addition, control signals g_out(5) to g_out(N+4) are respectively input to control signal lines ws(1) to ws(N). In other words, control signal g_out(i+4) output by driver circuit $D_{i+4}$ of the (i+4)th stage is input to control signal line ws(i).

5-2. Driving Method

Figure 18:
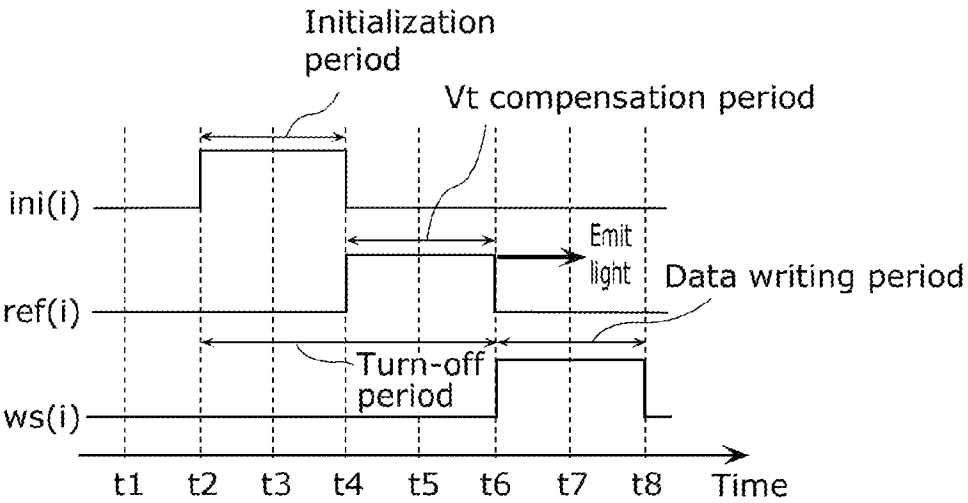
FIG. 18 is a timing chart illustrating a driving pulse that is input to each of the control signal lines in a subpixel circuit of the display device according to Embodiment 5.

Next, the method of driving the display device according to the present embodiment will be described with reference to FIG. 18. FIG. 18 is a timing chart illustrating a driving pulse that is input to each of the control signal lines in subpixel circuit 11R of the display device according to the present embodiment. In FIG. 18, a driving pulse input to each of the control signal lines in subpixel circuit 11R included in pixel circuit 10 located in the i-th row among the plurality of pixel circuits 10 arranged in a matrix are indicated.

As illustrated in FIG. 18, the control signals are each at the L level from time t1 to time t2, and light emitting element $EL_R$ is in a luminescent state that corresponds to a data signal in an immediately preceding vertical cycle.

Next, at time t2, a driving pulse is input to control signal line ini(i). Accordingly, the control signal input to control signal line ini(i) is at the H level from time t2 to time t4. Control signal g_out(i) from driver circuit $D_i$ of the i-th stage of gate driver 413 is input to control signal line ini(i) of subpixel circuit 11R included in pixel circuit 10 located in the i-th row, and control signal g_out(i) is at the H level from time t2 to time t4.

Next, at time t4, the control signal input to control signal line ini(i) turns to the L level, and the driving pulse is input to control signal line ref(i). As a result, the control signal input to control signal line ref(i) is at the H level from time t4 to time t6. In other words, the control signal g_out(i+2) from driver circuit $D_{i+2}$ of the (i+2)th stage of gate driver 413 turns to the H level.

Next, at time t6, the control signal input to control signal line ref(i) turns to the L level, and the driving pulse is input to control signal line ws(i). As a result, the control signal input to control signal line ws(i) is at the H level from time t6 to time t8. In other words, the control signal g_out(i+4) from driver circuit $D_{i+4}$ of the (i+4)th stage of gate driver 413 turns to the H level.

As described above, with the method of driving the display device according to the present embodiment as well, it is possible to drive each of the subpixel circuits in the same manner as the method of driving display device 1 according to Embodiment 1.

It should be noted that, although the width of each of the driving pulses corresponds to two horizontal cycles according to the present embodiment, the width of each of the driving pulses is not limited to this example. For example, the width of each of the driving pulses may correspond to three horizontal cycles or more.

5-3. Advantageous Effects

With the display device and the method of driving the display device according to the present embodiment as well, it is possible to yield advantageous effects equivalent to the advantageous effects yielded by display device 1 and the method of driving display device 1 according to Embodiment 1. In addition, it is possible to cause the initialization period, the Vt compensation period, and the writing period to be longer than one horizontal cycle with the display device and the method of driving the display device according to the present embodiment. As a result, it is possible to appropriately drive each of the subpixel circuits even when it takes a longer period of time than one horizontal cycle for each of the periods.

OTHER EMBODIMENTS

Although the display device, etc. according to the present disclosure have been described based on exemplary embodiments thus far, the display device, etc. according to the present disclosure are not limited to those described in the foregoing embodiments. Embodiments resulting from arbitrary combinations of structural components of the different exemplary embodiments, embodiments resulting from various modifications of the exemplary embodiments that may be conceived by those skilled in the art without materially departing from the novel teachings and advantages of the present disclosure, and various devices that include the processing circuit, etc., according to the above exemplary embodiments are intended to be included within the scope of the present disclosure.

The display device according to Embodiment 2 may be combined with the display device according to Embodiment 3. In other words, an initialization pulse may be input to control signal line ref(i) of the subpixel circuit, and a plurality of driving pulses may be input in the Vt compensation period.

In addition, in the display devices according to Embodiments 2, 3, and 5, the gate driver may be separated into a first driver and a second driver as with the display device according to Embodiment 4.

In addition, the configuration of the pixel circuit in the display device according to the present disclosure is not limited to the configuration of the pixel circuit used in each of the above-described exemplary embodiments. For example, the pixel circuit may include only one or two subpixel circuits, or may include four or more subpixel circuits. In addition, the configuration of the subpixel circuit is not limited to the configuration of the subpixel circuit used in each of the above-described exemplary embodiments. Other known subpixel circuits may be used as the subpixel circuit.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is widely applicable to various video display devices such as mobile information terminals, personal computers, television receivers, etc., as a display device of which the width of the display frame can be reduced.

The invention claimed is:

1. A display device comprising:

a display portion including a plurality of pixel circuits arranged in a matrix; and a gate driver that outputs one driving pulse for each horizontal cycle, wherein the plurality of pixel circuits each include one or more subpixel circuits, the one or more subpixel circuits each include a light emitting element, a driving transistor that supplies a current to the light emitting element, a write transistor, a reference transistor, and an initialization transistor, the write transistor switches a conduction state between a gate electrode of the driving transistor and a data signal line to which a data signal corresponding to a luminance of the light emitting element is input, the reference transistor switches a conduction state between the gate electrode of the driving transistor and a reference potential line to which a reference potential is applied, the initialization transistor switches a conduction state between the light emitting element and an initialization potential line to which an initialization potential is applied, the one driving pulse is input per vertical cycle from the gate driver to the initialization transistor included in each of a plurality of rows included in the plurality of pixel circuits, and the one driving pulse input to initialization transistors included in mutually different rows among the plurality of rows is input to each of the write transistor and the reference transistor, the initialization transistors being the initialization transistor, the mutually different rows being other than a row in which the write transistor and the reference transistor are included.

2. The display device according to claim 1, wherein the one driving pulse input to the initialization transistor included in each of two mutually different rows among the plurality of rows is input to the reference transistor per vertical cycle, the two mutually different rows being other than a row in which the reference transistor is included.

3. The display device according to claim 2, wherein in a given subpixel circuit among the one or more subpixel circuits, a first driving pulse is input to the reference transistor after a second driving pulse is input to the initialization transistor and before a third driving pulse is input for the first time to the write transistor, and a fourth driving pulse is input to the reference transistor after the third driving pulse is input to the write transistor and before a fifth driving pulse is input for the first time to the initialization transistor, each of the first driving pulse, the second driving pulse, the third driving pulse, the fourth driving pulse, and the fifth driving pulse being the one driving pulse.

4. The display device according to claim 2, wherein in a given subpixel circuit among the one or more subpixel circuits, a first driving pulse and a second driving pulse are input to the reference transistor after a third driving pulse is input to the initialization transistor and before a fourth driving pulse is input for the first time to the write transistor, the first driving pulse and the second driving pulse being input respectively to the initialization transistors included in two mutually different rows among the plurality of rows other than the row in which the reference transistor is included, each of the first driving pulse, the second driving pulse, the third driving pulse, the fourth driving pulse being the one driving pulse.

5. The display device according to claim 1, wherein the gate driver includes a first driver and a second driver, each of the first driver and the second driver outputs the one driving pulse input to the initialization transistor included in at least one of the plurality of rows, and the display portion is disposed between the first driver and the second driver.

6. The display device according to claim 1, wherein the gate driver is a shift register of one system.

7. The display device according to claim 1, wherein a low (L) level of the one driving pulse is lower than the initialization potential.

8. A method of driving a display device, the display device including:

a display portion including a plurality of pixel circuits arranged in a matrix; and a gate driver that outputs one driving pulse for each horizontal cycle, the plurality of pixel circuits each including one or more subpixel circuits, the one or more subpixel circuits each including a light emitting element, a driving transistor that supplies a current to the light emitting element, a write transistor, a reference transistor, and an initialization transistor, the write transistor switching a conduction state between a gate electrode of the driving transistor and a data signal line to which a data signal corresponding to a luminance of the light emitting element is input, the reference transistor switching a conduction state between the gate electrode of the driving transistor and a reference potential line to which a reference potential is applied, the initialization transistor switching a conduction state between the light emitting element and an initialization potential line to which an initialization potential is applied, the method of driving the display device comprising:

inputting the one driving pulse per vertical cycle from the gate driver to the initialization transistor included in each of a plurality of rows included in the plurality of pixel circuits; and inputting the one driving pulse input to initialization transistors included in mutually different rows among the plurality of rows, to each of the write transistor and the reference transistor, the initialization transistors being the initialization transistor, the mutually different rows being other than a row in which the write transistor and the reference transistor are included.

* * * * *